US008641542B2

(12) United States Patent
Kitchen et al.

(10) Patent No.: US 8,641,542 B2
(45) Date of Patent: Feb. 4, 2014

(54) STATIONARY TRACK WITH GIMBALED RIDER CARRIAGES AMUSEMENT RIDE

(75) Inventors: William J. Kitchen, Windermere, FL (US); Cyril Jay Silberman, Miami Beach, FL (US); Barton L. Riberich, Minneapolis, MN (US)

(73) Assignee: William J. Kitchen, Windermere, FL (US)

( * ) Notice: Subject to any disclaimer, the term of this patent is extended or adjusted under 35 U.S.C. 154(b) by 94 days.

(21) Appl. No.: 13/394,108

(22) PCT Filed: Sep. 7, 2010

(86) PCT No.: PCT/US2010/047986

§ 371 (c)(1),
(2), (4) Date: Jun. 18, 2012

(87) PCT Pub. No.: WO2011/029093

PCT Pub. Date: Mar. 10, 2011

(65) Prior Publication Data

US 2012/0277008 A1 Nov. 1, 2012

Related U.S. Application Data

(60) Provisional application No. 61/239,852, filed on Sep. 4, 2009, provisional application No. 61/295,000, filed on Jan. 14, 2010.

(51) Int. Cl.
*A63G 27/00* (2006.01)
*A63G 27/02* (2006.01)

(52) U.S. Cl.
USPC ..... 472/45

(58) Field of Classification Search
USPC ..... 472/27, 28, 29, 39, 44, 45, 130; 104/74, 104/75, 76
See application file for complete search history.

(56) References Cited

U.S. PATENT DOCUMENTS 489,238 A 1/1893 Somers
512,429 A 1/1894 Wyand
(Continued)

FOREIGN PATENT DOCUMENTS

DE 3409523 8/1984
EP 1721647 11/2006
(Continued)

OTHER PUBLICATIONS

International Search Report in international application No. PCT/US2010/047986, mailed Aug. 24, 2011.
(Continued)

*Primary Examiner* — Kien Nguyen
(74) *Attorney, Agent, or Firm* — Margaret Polson; Oppedahl Patent Law Firm LLC

(57) ABSTRACT

A stationary track wheel ride is disclosed where a chain of rider carriages (gondolas) are driven around the stationary track. The rider carriages are rotationally mounted on axles on a support frame that allow the rider carriages to rotate around the axles so that the floor of the rider carriage remains approximately level with the ground while the rider carriage travels around the stationary track. A drive mechanism for the ride that simultaneously mounts the rider carriages to the track and provides the drive force is also include: a drive cable mechanism, motors attached to the track to drive the rider carriage train using drive wheels contacting some portion of the rider carriage. Motors attached to the rider carriage with drive wheels contacting the track. An emergency access assembly for fixed track rides and for Ferris wheel type rides is also disclosed.

31 Claims, 34 Drawing Sheets

(56) References Cited

U.S. PATENT DOCUMENTS

| | | | | |
|---|---|---|---|---|
| 567,861 | A | | 9/1896 | Mustain |
| 759,053 | A | | 5/1904 | Whittemore |
| 803,465 | A | | 10/1905 | Bernheisel |
| 959,595 | A | | 5/1910 | Pfaffenbach |
| 1,050,567 | A | | 1/1913 | Saunders |
| 2,009,904 | A | | 7/1935 | Purves |
| 2,082,287 | A | | 6/1937 | Hermann |
| 2,135,230 | A | | 11/1938 | Courtney |
| 2,384,237 | A | | 9/1945 | Clark |
| 2,423,283 | A | | 7/1947 | Austin |
| 2,498,450 | A | | 2/1950 | Pewitt |
| 2,499,470 | A | | 3/1950 | Duncan |
| 2,535,862 | A | | 12/1950 | Pewitt |
| 2,576,477 | A | | 11/1951 | Powell |
| 2,738,885 | A | * | 3/1956 | Demaline ..... 414/250 |
| 3,596,905 | A | | 8/1971 | Brown |
| 3,610,160 | A | | 10/1971 | Alimanestianu |
| 3,610,614 | A | | 10/1971 | Nishizawa |
| 3,698,710 | A | | 10/1972 | Schwarzkopf |
| 3,985,081 | A | | 10/1976 | Sullivan |
| 4,988,089 | A | | 1/1991 | Knijpstra |
| 5,081,932 | A | | 1/1992 | Hofmann |
| 5,272,984 | A | | 12/1993 | Bolliger et al. |
| 5,319,897 | A | | 6/1994 | Royer |
| 5,775,226 | A | | 7/1998 | Futami et al. |
| 6,001,022 | A | | 12/1999 | Spieldiener et al. |
| 6,047,645 | A | | 4/2000 | Cornwell et al. |
| 6,066,049 | A | | 5/2000 | Milanian |
| 6,227,120 | B1 | | 5/2001 | Fritz |
| 6,269,750 | B1 | | 8/2001 | Cornwell et al. |
| 6,402,624 | B1 | | 6/2002 | Larson et al. |
| 6,477,961 | B1 | | 11/2002 | Mares |
| 6,953,377 | B2 | | 10/2005 | Quercetti |
| 6,994,629 | B2 | | 2/2006 | Bussink |
| 7,008,328 | B2 | | 3/2006 | Checketts |
| 7,172,511 | B2 | | 2/2007 | Casey |
| 7,351,154 | B2 | | 4/2008 | Muller et al. |
| 7,594,473 | B2 | | 9/2009 | Kitchen et al. |
| 7,686,697 | B2 | | 3/2010 | Bissink |
| 7,987,793 | B2 | | 8/2011 | Blonk et al. |
| 8,096,890 | B2 | | 1/2012 | Anderson et al. |
| D656,213 | S | | 3/2012 | Kitchen |
| 2007/0113753 | A1 | | 5/2007 | Meindl et al. |
| 2007/0261589 | A1 | | 11/2007 | Bussink |
| 2008/0173208 | A1 | | 7/2008 | Heinrich |
| 2009/0064889 | A1 | | 3/2009 | Muller |
| 2009/0075740 | A1 | | 3/2009 | Kojro |
| 2009/0320712 | A1 | | 12/2009 | MacMahon et al. |
| 2011/0114907 | A1 | | 5/2011 | Hartman et al. |

FOREIGN PATENT DOCUMENTS

| | | | |
|---|---|---|---|
| EP | 1721647 | A1 | 11/2006 |
| GB | 21137 | | 0/1911 |
| GB | 22781 | | 0/1910 |
| GB | 320758 | | 10/1928 |
| JP | 05115618 | A | 5/1993 |
| JP | 2000-070554 | | 3/2000 |
| JP | 2001-104653 | | 4/2001 |
| JP | 2002-102544 | | 4/2002 |
| JP | 2002-159758 | | 6/2002 |
| JP | 2002-253867 | | 9/2002 |
| JP | 2002-273063 | | 9/2002 |
| JP | 2003-275471 | A | 9/2002 |
| JP | 2002-355446 | | 12/2002 |
| JP | 2002-360940 | | 12/2002 |
| JP | 2003-024647 | | 1/2003 |
| JP | 2003-210853 | | 7/2003 |
| JP | 2005-139834 | A | 6/2005 |
| JP | 2005-328897 | | 12/2005 |
| JP | 2007-105353 | | 4/2007 |
| JP | 2008-188384 | | 8/2008 |
| JP | 2008-212711 | | 9/2008 |
| JP | 2008-246160 | | 10/2008 |
| JP | 2009-148570 | | 7/2009 |
| WO | 00/29086 | A1 | 5/2000 |
| WO | 00/41789 | A1 | 7/2000 |
| WO | 03/082421 | A2 | 10/2003 |
| WO | 2004041380 | | 5/2004 |
| WO | 2006/127446 | A1 | 11/2006 |
| WO | 2007/145506 | A1 | 12/2007 |

OTHER PUBLICATIONS

Written Opinion of the International Searching Authority in international application No. PCT/US2010/047986, mailed Aug. 24, 2011.

International Preliminary Report on Patentability in international application No. PCT/US2010/047986.

Sigma-Composite, Basis of Design: Beijing Great Wheel Capsule, Jul. 31, 2008.

*Huff Alternative Fund* v. *Kanavos*, Verified Amended Complaint, Supreme Court of the State of New York, Jun. 27, 2011.

*US Thrillrides* v. *Uni-Systems*, Demand for Arbitration, American Arbitration Association, Jan. 20, 2012.

*Kitchen* v. *Silberman*, Verified Complaint, Circuit Court of the 11th Judicial Circuit, Miami-Dade County, FL, Case No. 12-03667CA20, Jan. 31, 2012.

*Kitchen* v. *Silberman*, Plaintiff's Verified Motion for Mandatory Injunction and Incorporated Memorandum of Law, Circuit Court of the 11th Judicial Circuit, Miami-Dade County, FL, Case No. 12-036667CA20, Jan. 31, 2012.

*US Thrillrides* v. *Uni-Systems*, Answer and Counterclaim, American Arbitration Association, Case No. 33517Y0002712, Feb. 6, 2012.

*Kitchen* v. *Silberman*, Plaintiff's First Request for Production of Documents, Circuit Court of the 11th Judicial Circuit, Miami-Dade County, FL, Case No. 12-03667CA20, Feb. 14, 2012.

*Kitchen* v. *Silberman*, Answer Affirmative Defenses and Counterclaim, Circuit Court of the 11th Judicial Circuit, Miami-Dade County, FL, Case No. 12-03667CA20, Feb. 21, 2012.

*Kitchen* v. *Silberman*, Hearing Transcript, Circuit Court of the 11th Judicial Circuit, Miami-Dade County, FL, Case No. 12-03667CA20, Feb. 28, 2012.

*Kitchen* v. *Silberman*, Order Granting Plaintiff's Motion for Mandatory Injunction, Circuit Court of the 11th Judicial Circuit, Miami-Dade County, FL, Case No. 12-03667CA20, Feb. 28, 2012.

*Uni-Systems* v. *US Thrillrides*, Complaint, US District Court Northern District of Florida, Case No. 4:12-cv-00165, Apr. 9, 2012.

*Uni-Systems* v. *US Thrillrides*, Amended Complaint, US District Court Northern District of Florida, Case No. 4:12-cv-00165, May 14, 2012.

*Silberman* v. *Kitchen*, Order carrying Motion to Dismiss and to Strike with the case, District Court of Appeal of Florida, Third District, Case No. 3D12-859, May 24, 2012.

*Kitchen* v. *Silberman*, Defendant's Motion for Reconsideration of Mandatory Injunction Order, or in the Alternative, Motion to Dissolve Mandatory Injunction, Circuit Court of the 11th Judicial Circuit, Miami-Dade County, FL, Case No. 12-03667CA20, May 25, 2012.

*US Thrillrides* v. *Uni-Systems*, Answer and Amended Counterclaim, American Arbitration Association, Case No. 33517Y0002712, Jun. 12, 2012.

*Silberman* v. *Kitchen*, Appellee's Response in Opposition to Appellant's Motion to Relinquish Jurisdiction, District Court of Appeal of Florida, Third District, Case No. 3D12-859, Jun. 15, 2012.

*Silberman* v. *Kitchen*, Order Denying Appellant's Motion to Relinquish Jurisdiction, District Court of Appeal of Florida, Third District, Case No. 3D12-859, Jun. 21, 2012.

*Silberman* v. *Kitchen*, Appellant's Motion for Rehearing and/or Reconsideration, District Court of Appeal of Florida, Third District, Case No. 3D12-859, Jul. 6, 2012.

*Silberman* v. *Kitchen*, Appellee's Response in Opposition to Appellant's Motion for Rehearing/Reconsideration of Order Denying Motion to Relinquish Jurisdiction, District Court of Appeal of Florida, Third District, Case No. 3D12-859, Jul. 10, 2012.

*Silberman* v. *Kitchen*, Order Granting Motion for an Extension of Time and Denying Rehearing, District Court of Appeal of Florida, Third District, Case 3D12-859, Jul. 11, 2012.

(56) References Cited

OTHER PUBLICATIONS

*US Thrillrides* v. *Uni-Systems*, Order Overruling Respondent's Jurisdictional Objections, American Arbitration Association, Case No. 33517Y0002712, Jul. 17, 2012.
*Silberman* v. *Kitchen*, Appellant's Initial Brief, District Court of Appeal of Florida, Third District, Case No. 3D12-859, Jul. 20, 2012.
*Uni-Systems* v. *US Thrillrides*, Memorandum of Law Opposing Defendant's Motion to Dismiss and Consenting to Stay of Action Pending Arbitration, US District Court Northern District of Florida, Case No. 4:12-cv-00165, Jul. 23, 2012.
*Kitchen* v. *Silberman*, Order Denying in Part Plaintiffs Motion to Dismiss Counterclaims, Circuit Court of the 11th Judicial Circuit, Miami-Dade County, FL, Case No. 12-03667CA20, Sep. 12, 2012.
*Uni-Systems* v. *US Thrillrides*, Joint Stipulation for Dismissal with Prejudice, US District Court Northern District of Florida, Case No. 4:12-cv-00165, Nov. 1, 2012.
*Kitchen* v. *Silberman*, Stipulation of Dismissal, District Court of Appeal of Florida, Third District, Case No. 3D12-859, Nov. 8, 2012.
*US Thrillrides* v. *Uni-Systems*, Joint Stipulation for Dismissal with Prejudice, American Arbitration Association, Case No. 33517Y0002712, Nov. 14, 2012.
*Kitchen* v. *Silberman*, Hearing Transcript, Circuit Court of the 11th Judicial Circuit, Miami-Dade County, FL, Case No. 12-03667CA20, Feb. 27, 2012.
Extended European Search Report dated May 8, 2013 for related case EP 10814626.7.

* cited by examiner

STATIONARY TRACK WITH GIMBALED RIDER CARRIAGES AMUSEMENT RIDE

CROSS REFERENCE APPLICATIONS

This application is a non-provisional application claiming the benefit of provisional application No. 61/239,852; filed Sep. 4, 2009 and provisional application No. 61/295,000; filed January 14, both of which are hereby incorporated by reference for all purposes.

BACKGROUND

Ferris wheel and similar rides are well known in the art. In the standard Ferris wheel, the rider carriages are mounted on a vertical wheel and the wheel itself is rotated. Several prior art designs of stationary wheel type rides are known, or roller coaster type rides with a carriage that goes around the stationary track. These rides present a number of difficulties, including complexity and rider evacuation issues in the event of an emergency.

The foregoing example of the related art and limitations related therewith are intended to be illustrative and not exclusive. Other limitations of the related art will become apparent to those of skill in the art upon a reading of the specification and a study of the drawings.

SUMMARY

One aspect of the disclosure is to provide a vertical wheel type ride that can be in a shape other than a circle. Tracks could be designed in any number of geometric shapes, including ovals, triangles and asymmetric designs.

One aspect is to provide a support carriage that is driven along the stationary track via one continuous loop linkage with a rider carriage rotationally attached to the support carriage such that the rider carriage can rotate freely around a suspension bar of the support carriage.

One aspect of the present disclosure is to provide a repair and evacuation means such that any rider carriage can be reached quickly.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

A stationary track wheel ride is disclosed where a chain of rider carriages (gondolas) are driven around the stationary track. The rider carriages are rotationally mounted on axles on a support frame that allow the rider carriages to rotate around the axles so that the floor of the rider carriage remains approximately level with the ground while the rider carriage travels around the stationary track. One embodiment has an active sway control mechanism to control the amount of sway in the rider carriage. Possible embodiment of drive mechanisms include: a drive cable mechanism, motors attached to the track to drive the rider carriage train using drive wheels contacting some portion of the rider carriage. Motors attached to the rider carriage with drive wheels contacting the track. The track can be formed using a tri-cord truss system and/or a plate and girder system. Other possible structures could be used to form the stationary track as well.

One embodiment of an emergency access assembly is mounted on a separate track that is mounted next the track that supports the rider carriages. The emergency access assembly has a frame that moves on the separate track with an emergency access carriage is rotationally mounted on an axle mounted on the frame. The emergency access carriage is mounted on its axle such that the floor of the emergency access carriage is approximately co-planar with the floor of the rider carriage when the emergency access carriage is alongside the rider carriage.

One embodiment of the emergency access assembly is mounted on a separate track from the rider carriage and in one embodiment the emergency access assembly is mounted on the same track as the rider carriage.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION

Figure 1:
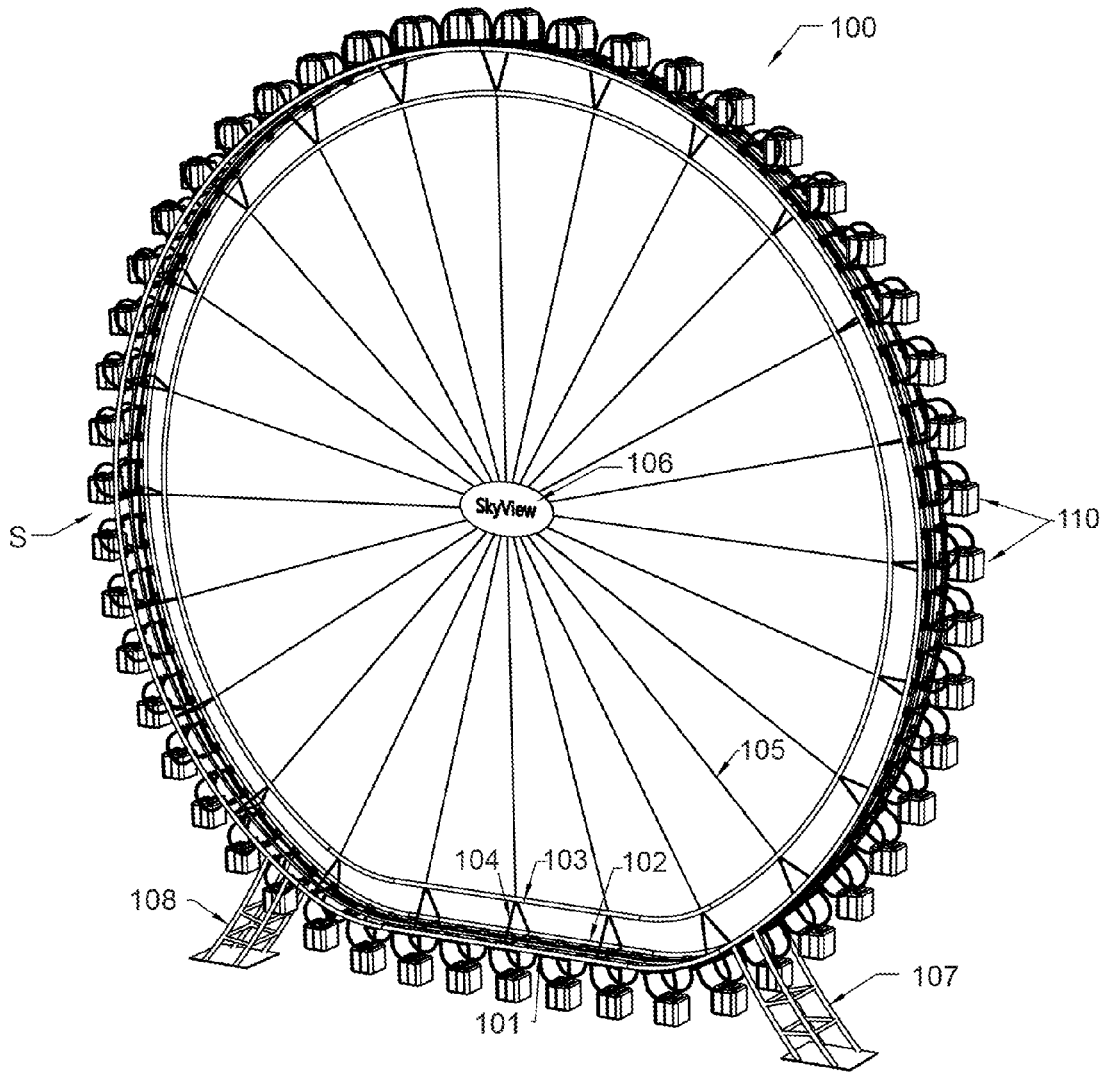
FIG. 1 is a perspective view of one embodiment of the amusement ride track.
Figure 2:
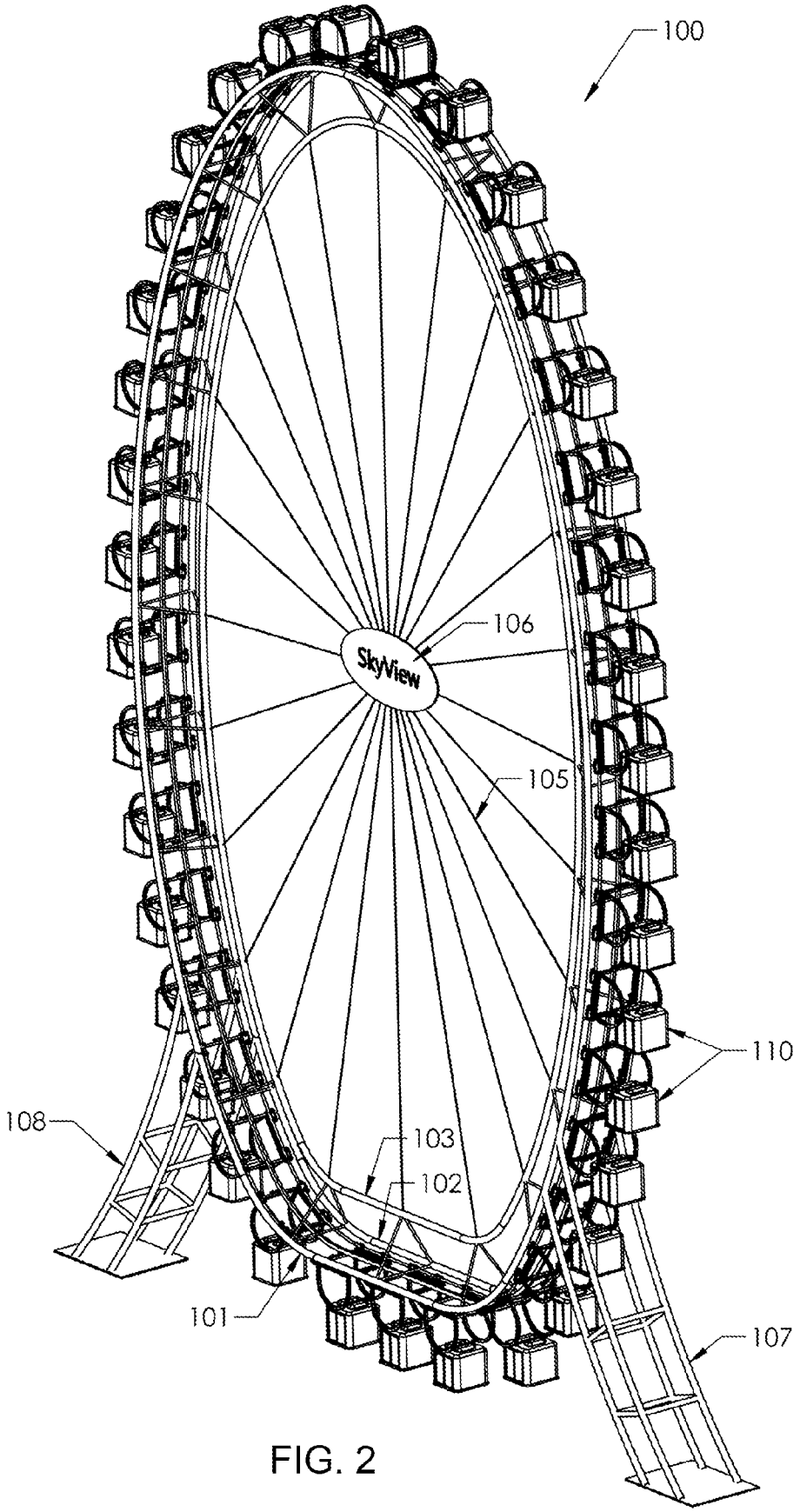
FIG. 2 is a perspective view of a different shaped track

Referring first to FIGS. 1 and 2, an amusement ride 100 is shown with a support track S made of three support rails 101, 102 and 103 in a triangular shape attached together with braces 104, referred to in the art as a tri-cord truss. Other truss shapes and types could be used as well to form the support track S, so long as they provided sufficient structural support and stability for the track. Spokes 105 attach to center plate 106 to provide additional stability. The spokes 105 can be cables, tension rods or similar types of devices that are known in the art as stabilizers. One skilled in the art will be aware that any of a large number of suitable equivalents could be utilized, no limitation as to the type of stabilizers used for the spokes 105 is intended. Legs 107 and 108 hold the support track substantially vertical and suspended far enough off the ground to allow the rider carriages 110 to move freely at the bottom of the ride 100; additional support for lateral stability would be needed, but is not shown for clarity. In certain locations or depending on the total height of the amusement ride 100, additional stabilizers such as guy wires (not shown) may be needed or required by local building codes. The amusement ride 100 could have a total height of approximately 200 to 1000 feet (60 meters to 300 meters) high.

A passenger loading area (not shown) could be located at one area at the bottom of the ride or raised to be on one side. Any number of known in the art ways of designing a passenger loading area could be utilized. For example legs 107 and 108 could be on opposing sides of some sort of viewing area of interest, for example an aquarium or natural cave and the passenger loading area could be located on one side and not at the bottom of the ride 100 to provide the riders with a view at the bottom of the ride 100.

Figure 3:
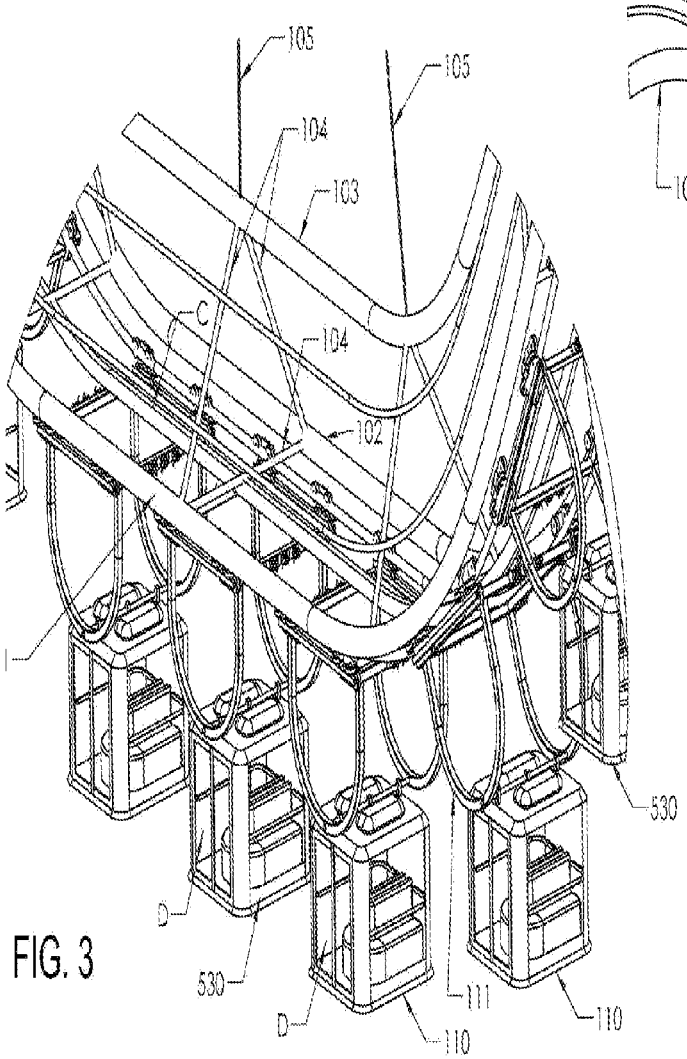
FIG. 3 is a perspective view of the bottom of the track with the rider carriages.
Figure 4:
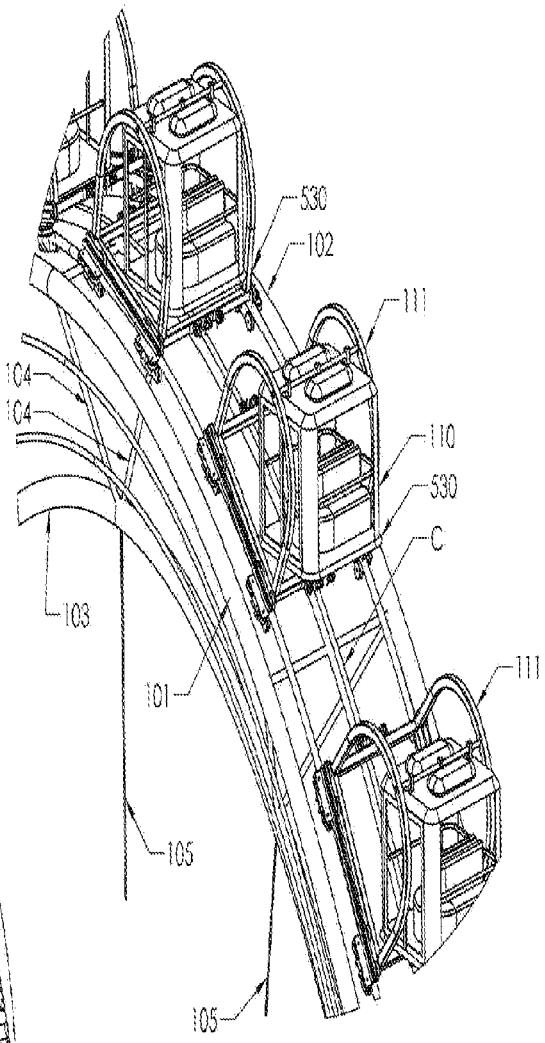
FIG. 4 is a perspective view of a top corner of the track with the rider carriages.

FIGS. 3 and 4 are close up views of the rider carriages 110 on the support carriages 111 at different locations on the ride 100 showing the rotation of the rider carriages 110 on the support carriages 111 with the floor 530 of the rider carriages 110 remaining, on average, substantially level as the rider carriages traverse around the track S. The floor 530 should always remain within a range of level that reduces the chance that that the riders would fall against the sides. Doors D on the rider carriages 110 allow for rider access to the interior of the rider carriage 110. If desired, the floor and/or roof of the rider carriage 110 could be made at least partially of transparent material as well as the sides, as shown in the depicted embodiment. Center rail C is an electrical feed rail to provide electricity to the rider carriages and track in a manner well known in the art of amusement rides. Its function and connections will not therefore be further described.

Figure 5:
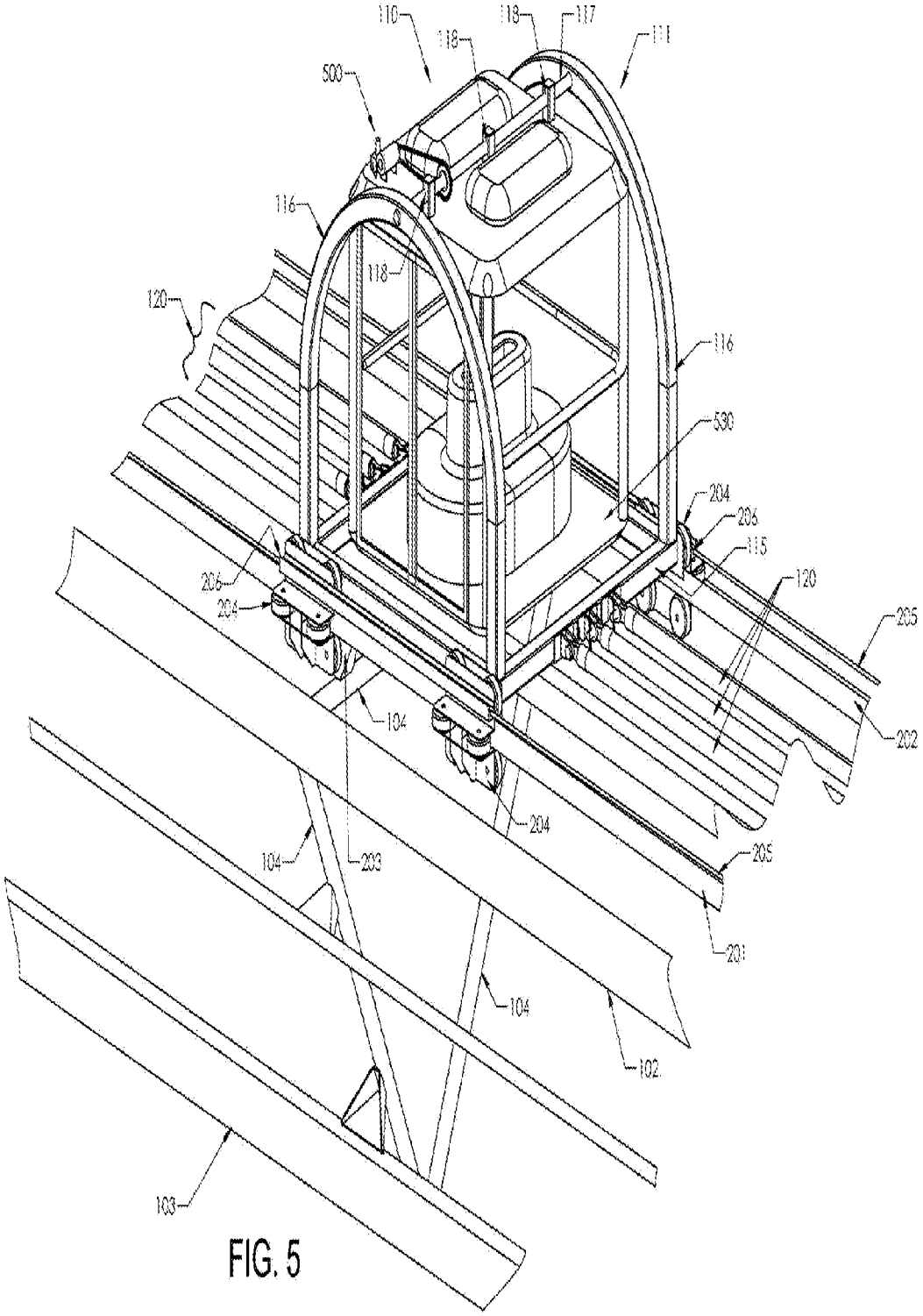
FIG. 5 is a perspective view of a single support carriage on the track with the rider carriage.

Referring next to FIG. 5, the tri-cord truss members 101, 102 and 103 support the guide rails 201 and 202, which form the track S for the amusement ride 100. The guide rails 201, 202 are mounted to the braces 104 with brackets 203. The support carriages 111 are movably mounted on guide rails 201 and 202 via roller mounts 204. Roller mounts 204 are well known in the roller coaster art, and therefore will not be further described. A number of different designs of such mounts are known in the amusement ride art, and no limitation of which type is to be used should be inferred from the depicted embodiment. All serve the function of locking the support carriages to the guide rails 201 and 202 such that the support carriage 111 stays movably attached to the guide rails regardless of the orientation of the support carriage 111 to the guide rails 201 and 202. This holds the support carriage 111 on the guide rails 201 and 202 as the support carriages 111 traverse the continuous loop of the track S.

The support carriages 111 have rigid frame 114 with base 115 to which the roller mounts 204 are attached. The base 115 is shown as an open frame in FIG. 6, but if desired a solid base could be used as well. The base 115 does not extend laterally beyond the support rails 101 and 102 in the depicted embodiment. Side frames 116 are mounted to base 115 on opposing sides of the base 115. The shape of the side frames 116 can be chosen for any desired ornamental appearance. Axle 117 is mounted between the side frames 116 at the top. It is preferable that axle 117 is mounted at the center top of side frames 116 for even weight distribution over the life of the ride, but this is not required. Rider carriage 110 is mounted on gimbaled bearings 118 to rotate around axle 117 as seen in FIG. 5. Multiple gimbaled bearings 118 are used to mount the rider carriage 110, three in the depicted embodiment. This is both for safety and to prevent sway and undesired rotation in directions other than around the axle 117. Gimbaled bearings 118 can have motion damping means to keep the orientation of the floor 530 of the rider carriage 110 within chosen limits of level. This prevents and rider movement within the rider carriage 110 or wind from causing too much rocking of the rider carriage 110. Standard motion dampers such as springs, hydraulics, dash pots and other shock absorption devices can be used. In some applications and active sway control mechanism 500 can be used as well. The rider carriage 110 is sized such that it can rotate fully around the axle 117 without contacting the side frames 116 or the base 115. Sufficient clearance is also provided such that any swaying of the rider carriage that occurs will not bring the rider carriage into contact with other parts of the structure.

Figure 7:
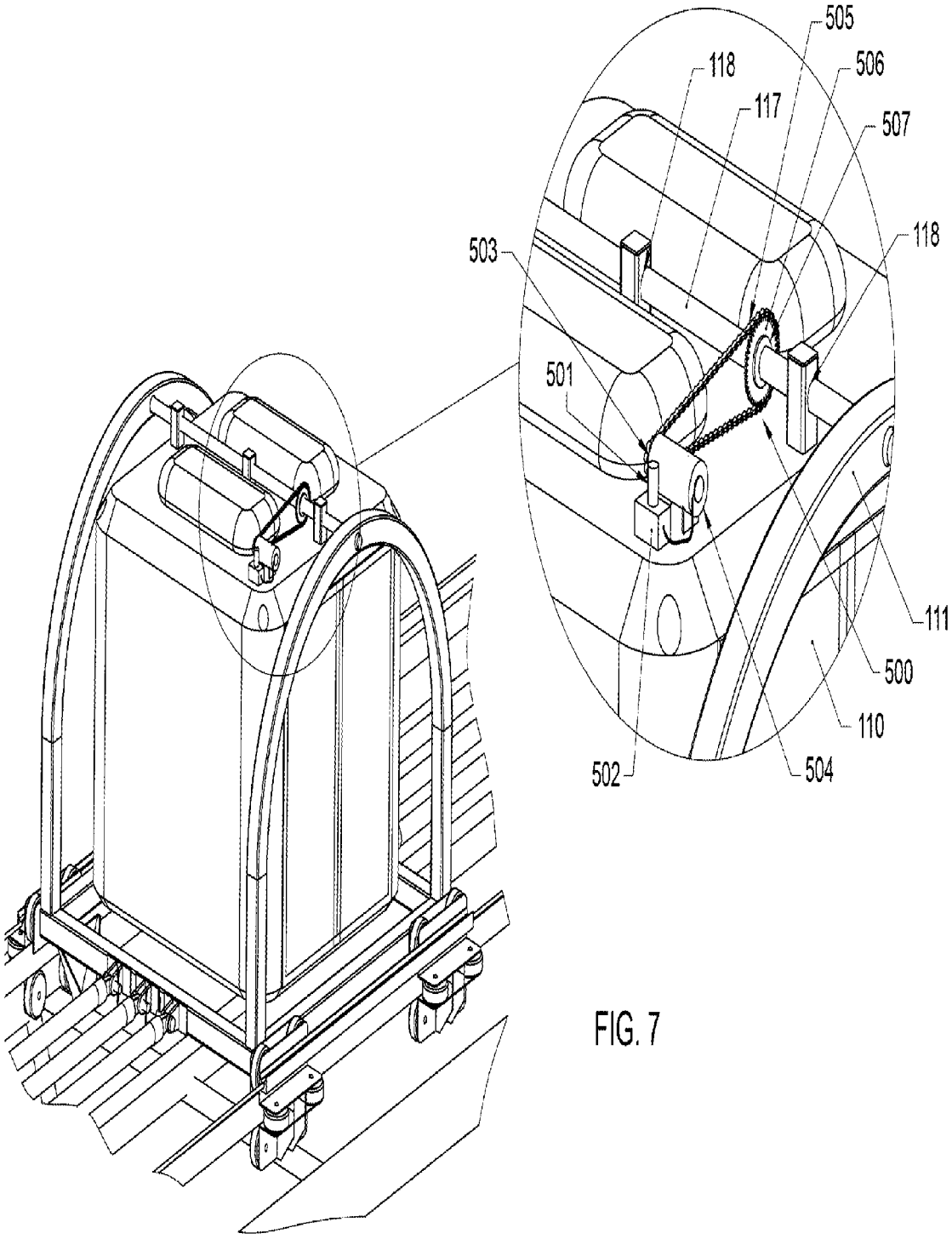
FIG. 7 is a close up of the active sway control mechanism.

FIG. 7 is a top perspective view of one embodiment of the active sway control mechanism 500. The active sway control mechanism 500 helps to keep the movement of the rider carriage 110 caused by the rotation of the rider carriage, the movement of the passengers inside the rider carriage, wind and other factors within desired parameters. The amount of sway tolerated and/or desired will depend on the conditions that each ride is operated under. In some instances, it will be desirable to keep sway to the minimal possible level. In other conditions, it may be desirable to have more motion in the rider carriage and have the floor 530 spend less time a substantially level. The active sway control mechanism 500 has a sensor package 501 that detects the speed of motion, direction of motion and inclination from level of the rider carriage 110. Accelerometers, inclinometer and G sensors are among the sensors that can be included in the sensor package 501. The information from the sensor package 501 is transmitted to a signal processing unit 502, which is attached to the sensor package in the depicted embodiment. The signal processing unit 501 compares the signals being received from the sensor package with the desired parameters. In some instances, it may be desirable for the amount of movement tolerated in the rider carriage 110 to be adjustable. For example, there could be controls within each individual rider carriage 110 that would allow the riders to choose the amount of motion experienced within a given range. The signal processing unit 502 controls motor 504 with first axel sprocket 503. The axel 117 has a second axel sprocket 506, which will be larger than the first axel sprocket 503. The two sprockets are connected by chain 505, allowing the motor 504 to apply force to axel 117 to control the motion of rider carriage 110 as desired. A slip mechanism 507 is provided to prevent damage to the mechanism and to prevent an upset to the carriage if the mechanism were to malfunction or jam.

Figure 6:
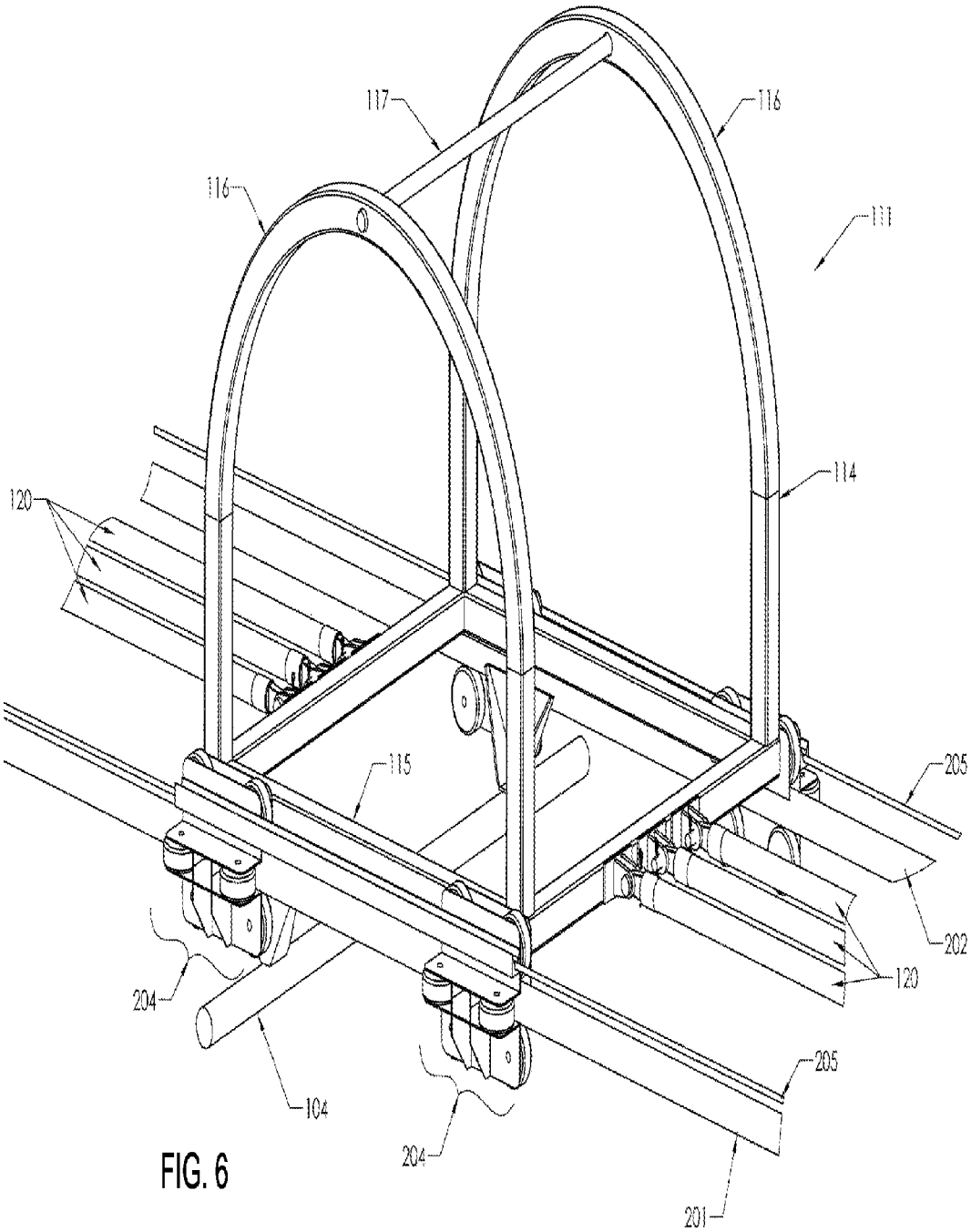
FIG. 6 is perspective view of the support carriage on the guide rails.

As seen in FIGS. 5 and 6, the support carriages 111 are attached together with steel spacer rods 120 and form a closed loop within the ride 100, providing further stability and weight balancing of the ride in this embodiment. This closed loop forms a continuous chain around the circumference of the ride, providing weight distribution and balancing the load. In the disclosed embodiment three rods 120 are pivotally attached to the base 115, but more or fewer rods 120 could be used. At least two rods 120 should be used for safety reasons. The support carriages 111 needs to be spaced far enough apart to allow for the rotation of the rider carriages 110, but it will often be desirable to have the carriages as close together as safety allows to provide for the maximum capacity for the amusement ride. Drive cables 205 are run through groove 206 on base 115 and are driven by a standard cable drive mechanism. Drive cables 205 lie in a v-shaped groove 206 and are held still relative to the support carriages 111 by friction. The drive cables 205 are lifted off the support carriage 111 to pass through the drive mechanism in a known manner.

Figure 8:
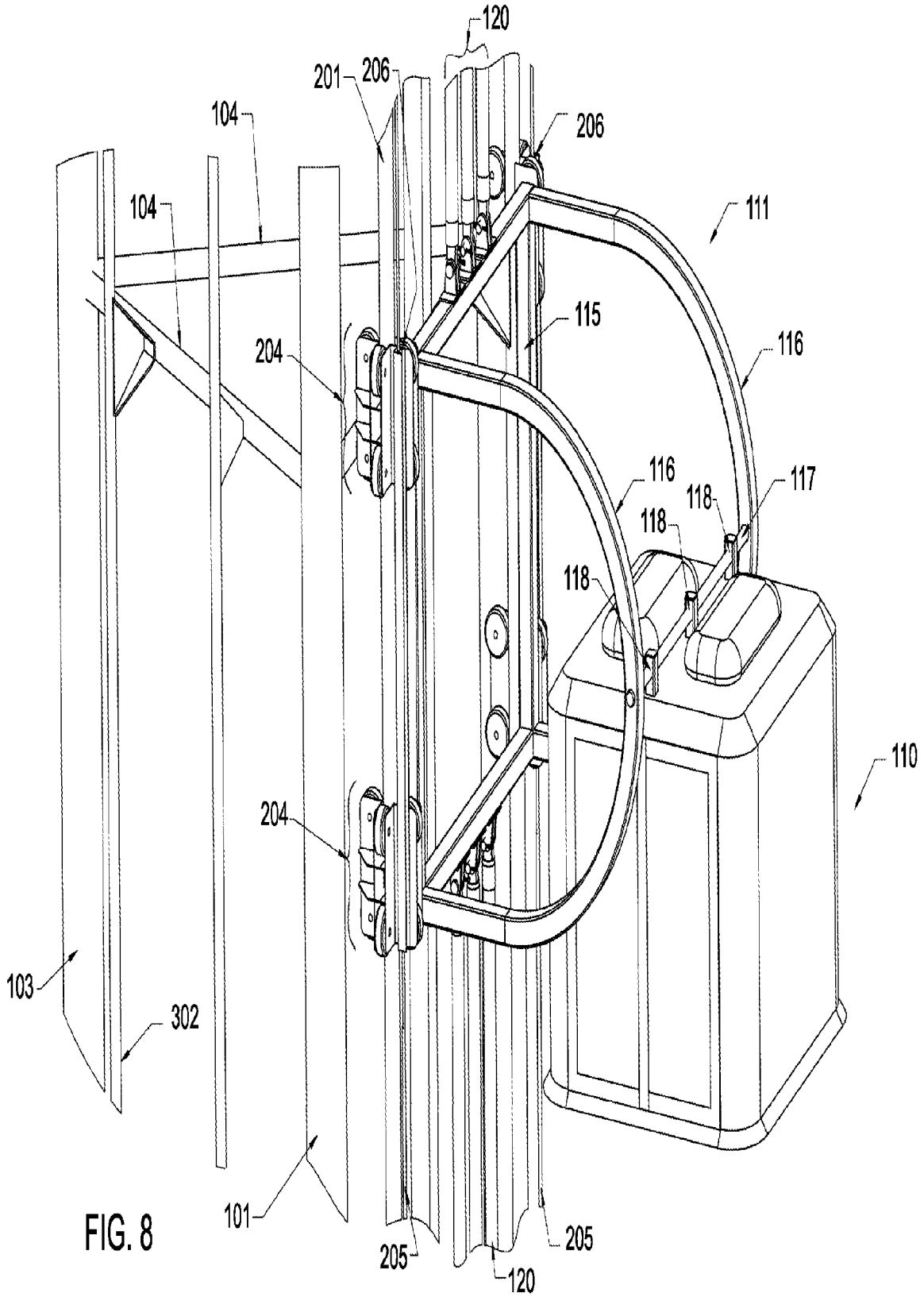
FIG. 8 is a perspective view of the rider carriage rotated 90 degrees.
Figure 9:
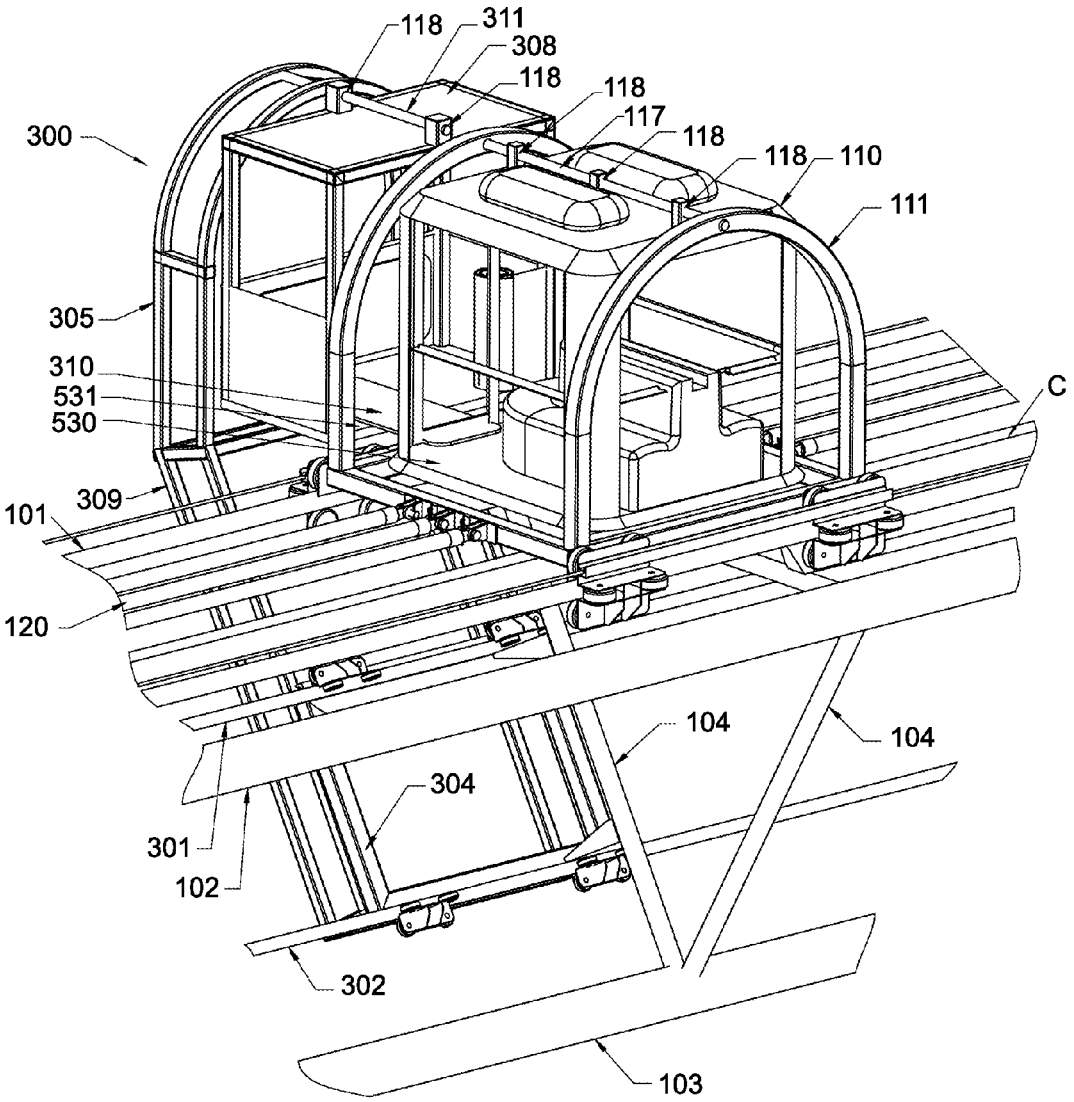
FIG. 9 is a perspective view of the emergency access carriage in place next to a rider carriage at the top of the track.
Figure 10:
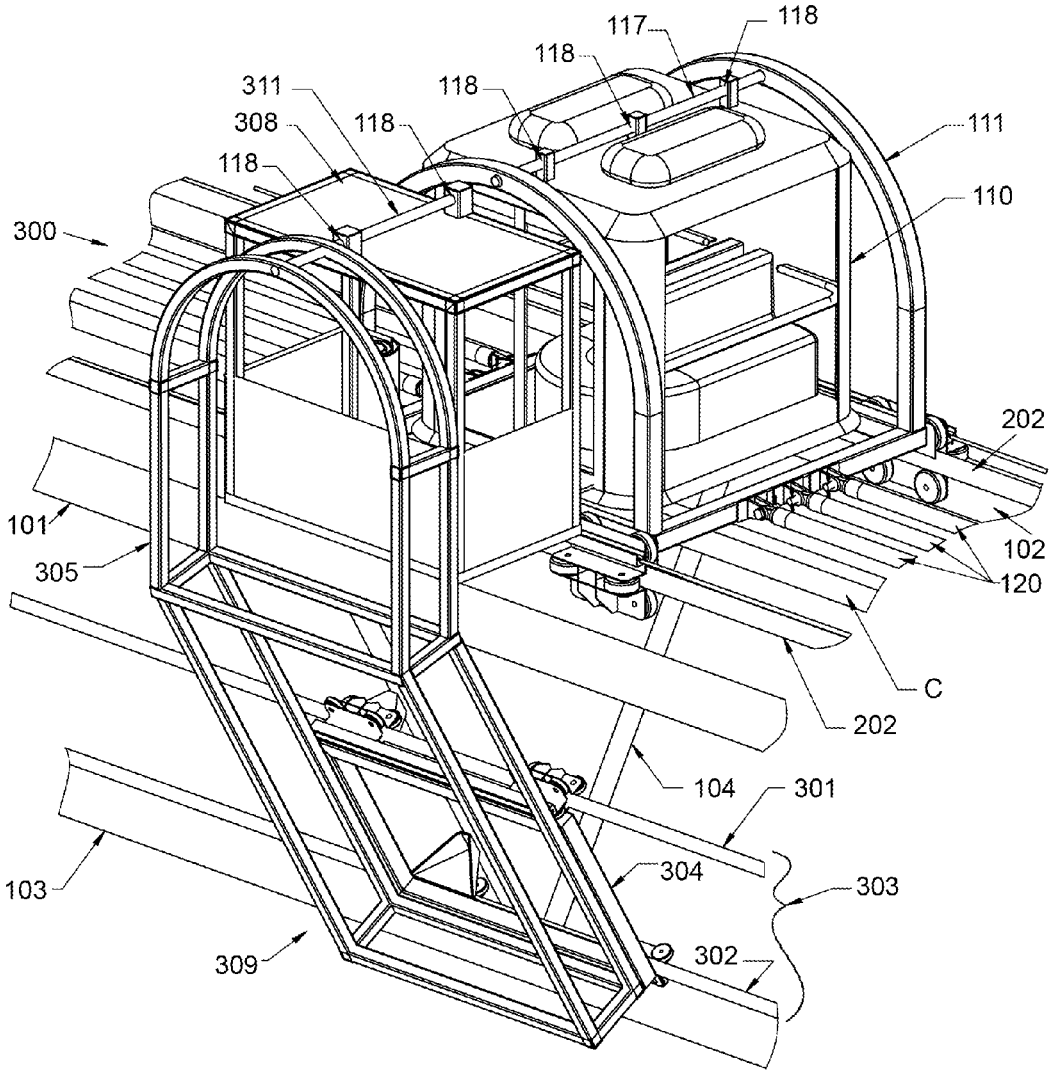
FIG. 10 is a perspective view of the emergency access carriage from the other side.
Figure 11:
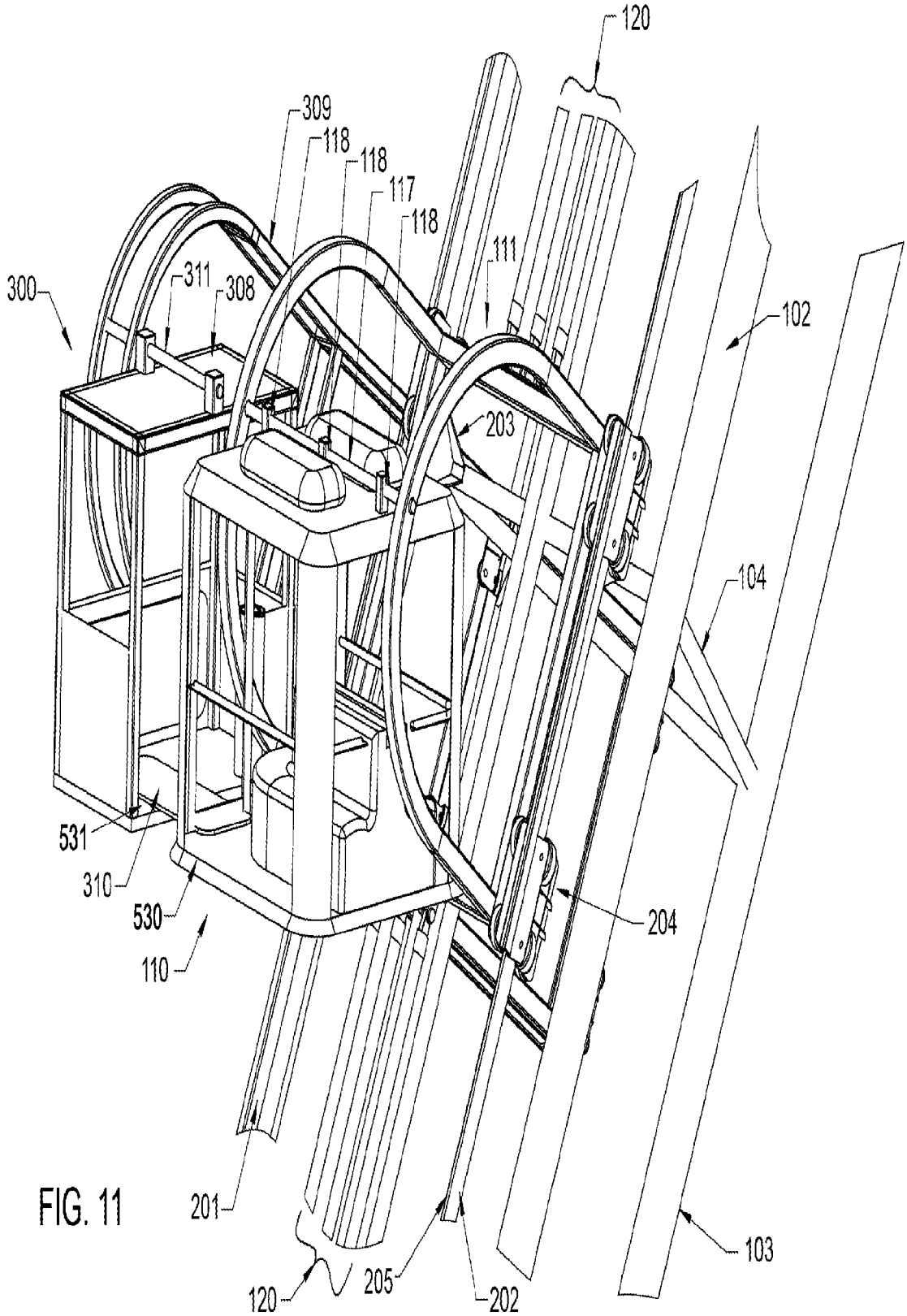
FIG. 11 is a perspective view of the emergency access carriage next to a rider carriage on the side of the track.
Figure 29:
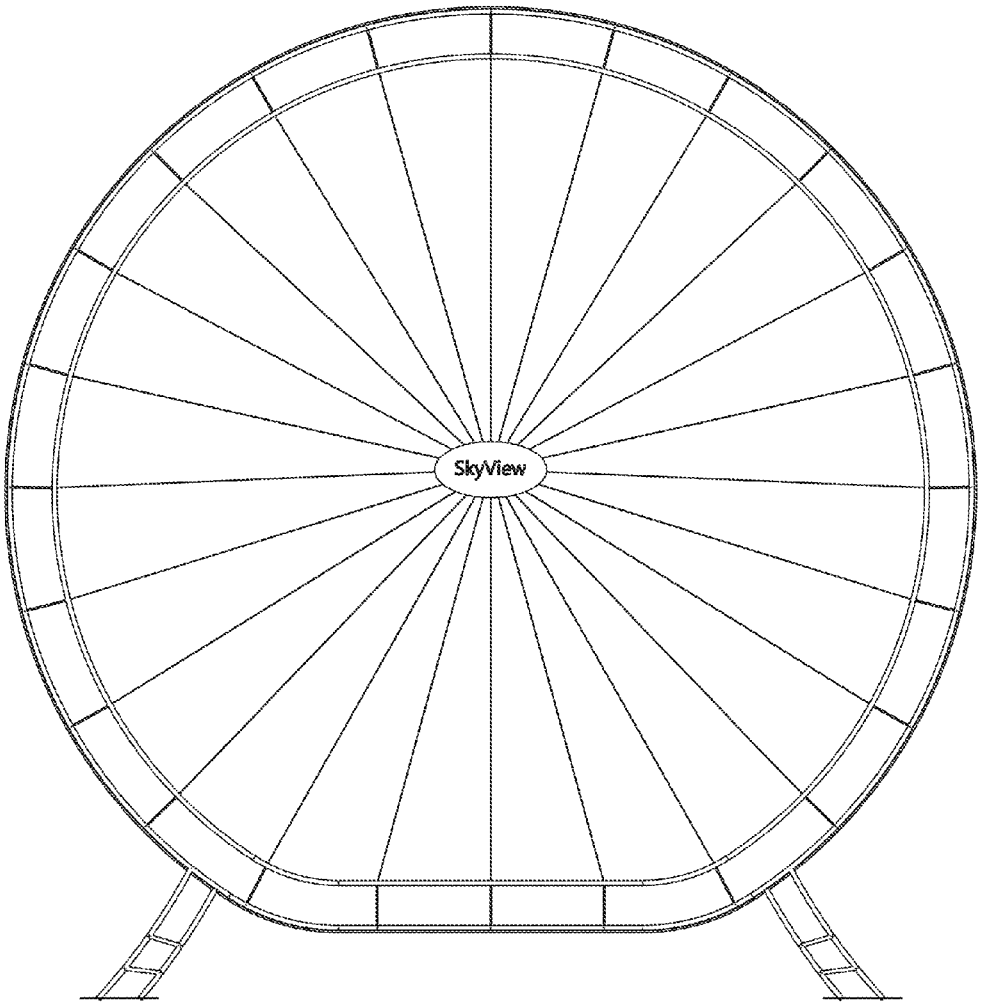
FIG. 29 is a side elevation view of an alternate shape for the track.
Figure 30:
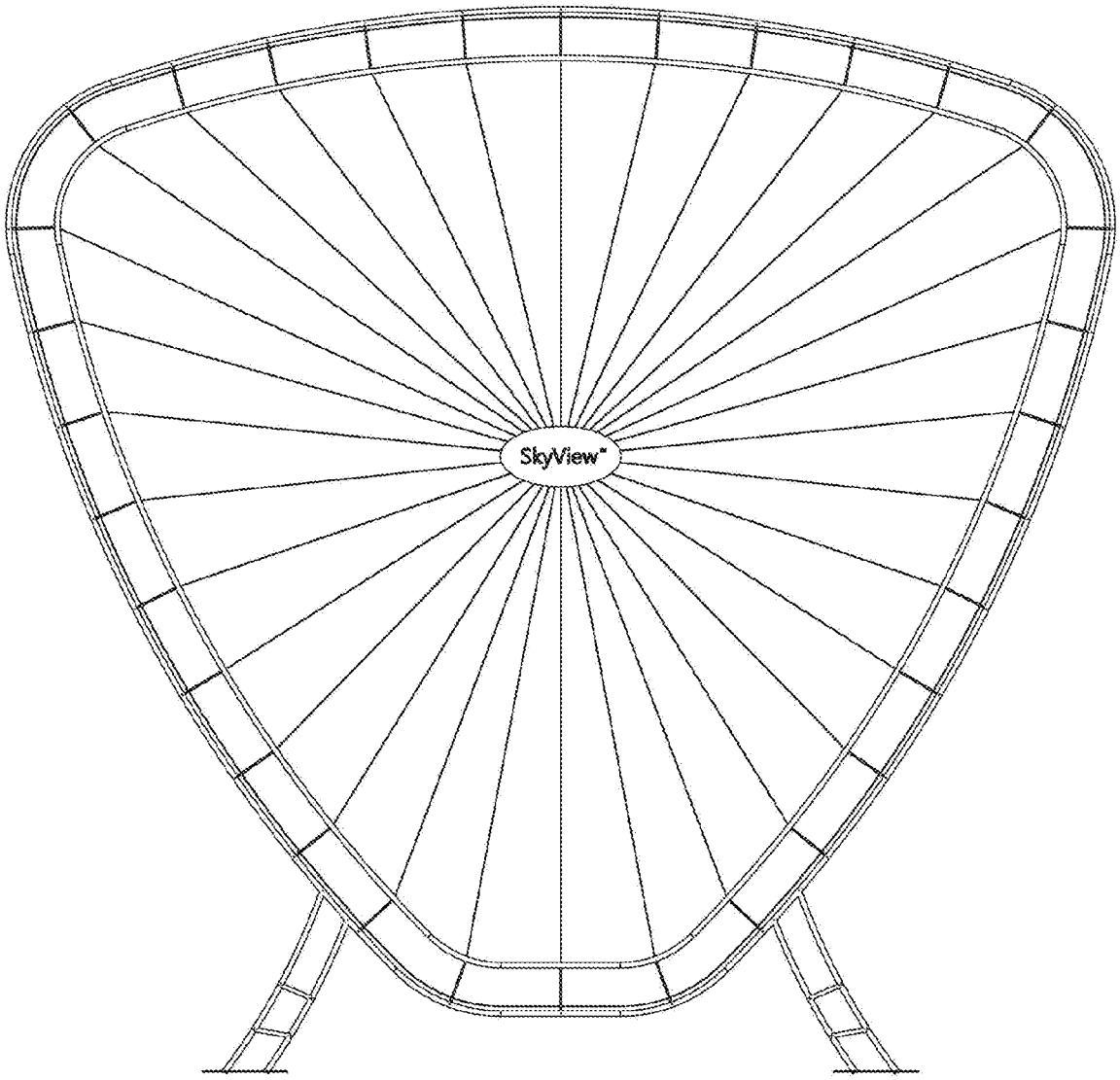
FIG. 30 is a side elevation view of an alternate shape for the track.
Figure 31:
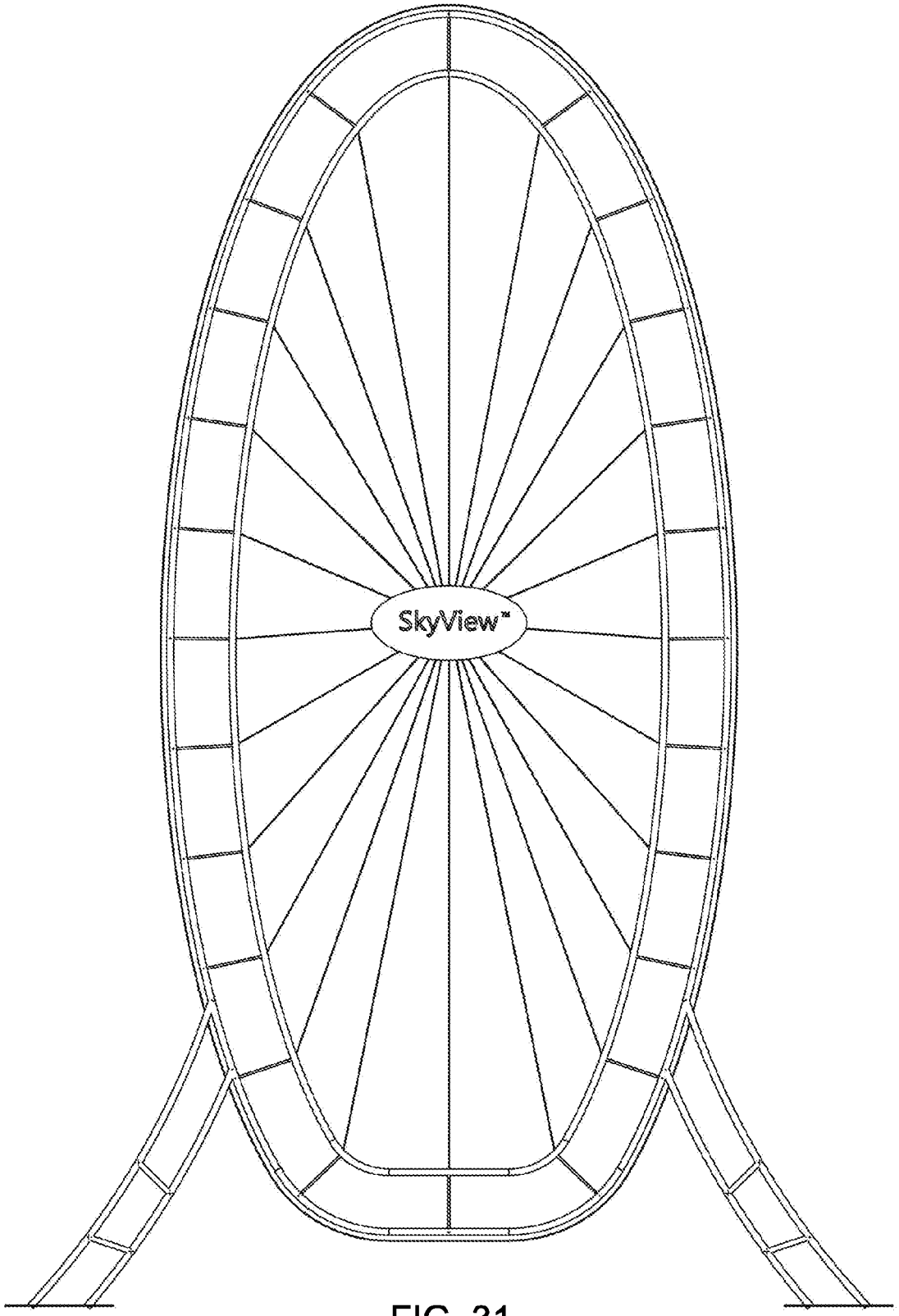
FIG. 31 is a side elevation view of an alternate shape for the track.

In case there is a need to access a rider carriage 110 that is not located at the loading area and cannot be moved to the loading area for some reason (mechanical failure etc.) an emergency access assembly 300 is provided, as seen in FIGS. 8, 9 and 10. The emergency access assembly 300 can run on a separate side track 303, formed of rails 301 and 302 is mounted on one the side of the support track S. Although the depicted embodiment shows the side track on only one side of the support track S, if desired a second side track 303 could be mounted on the other side of support track S to increase the speed with which the ride 100 could be evacuated if for some reason the loop of support carriages could not be moved (failure of a drive cable 205 for example). Also, depending the shape of the track S, the separate side track 303 many not form a complete closed loop with the track S. For example, the track shown in FIG. 29, the side track 3030 may not need to run the full length of the flatten bottom section of the track S that runs substantially parallel to the ground. The emergency access assembly 300 has a support frame 309 with base 304 and carriage support 305. The support frame 309 is powered by a completely separate mechanism than the main cable drive. Possible drive mechanisms for the emergency access assembly include motors to directly drive the roller mounts 204, a chain system or a gear drive system. The drive mechanism for the emergency access assembly 300 can have a completely separate power supply from the main drive system, or can be made to be hooked up to emergency generators as needed, depending on the chosen design. It is necessary that some sort of power supply that is not part of regular energy grid be provided, such that the emergency access 300 assembly could be used in the case of a large-scale power outage.

The base 304 is mounted on to rail 301 and 302 with roller mounts 204 as described above. The base 304 extends above the support rails 101 and 102. The base 304 also spaces the carriage support 305 far enough from the side frame 116 to allow the emergency carriage 308 to be move alongside the support carriage 111 without coming into contact with the support carriage 111 or the tri-mode truss rails 101, 102 and 103. The spacing is enough to allow the emergency access assembly 300 to move freely around the support track S, but is close enough that gangplank 310 can be used to connect the rider carriage 110 to the emergency carriage 308.

The emergency access carriage 308 is mounted on axle 311 on gimbaled bearings 118. The axle 311 extends from the top of carriage support 305 as can be seen in FIGS. 8 and 9. It is important that floor 530 of the rider carriage 110 and the floor 531 of the emergency access carriage 308 can be aligned such that the floors are approximately co-planar to make transfer between the carriages easy for the passengers. One way to accomplish this is to ensure that the axle 117 of the rider carriage 110 and the axle 311 of the emergency access carriage 308 be at the same height above the support track so that they can be axially aligned. This allows the emergency access carriage 308 to be hanging at the same orientation of the rider carriage 110 when they are both on the side of the track as shown in FIG. 10. So long as the floors are at the same distance from the axle, then the floors will self-align most of the time. The gangplank 310 can have locking mechanisms (not shown) to lock it to both the emergency carriage 308 and the rider carriage 110. Extendable guard rails (not shown) could be provided as well.

Figure 12:
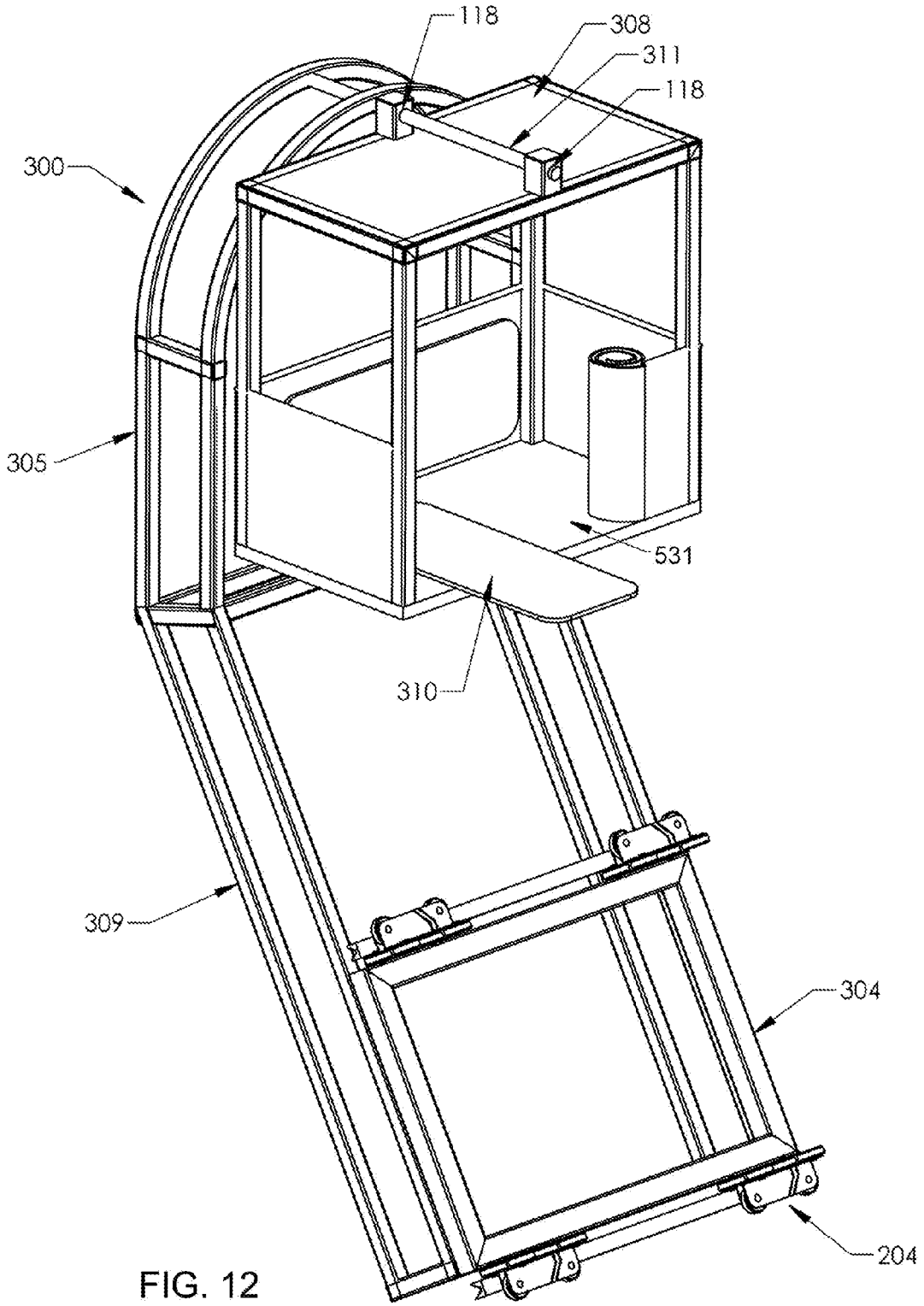
FIG. 12 is a perspective view of the emergency access carriage.

FIG. 12 is a perspective view of the emergency access assembly 300. The door is shown rolling back in the depicted embodiment, other types of doors could be used as well. The gangplank 310 is shown in the deployed position in FIG. 12. When the emergency access assembly 3000 is moving, the gangplank 310 would be inside the emergency access carriage 308. If desired the emergency access assembly 300 could be made with no viewing windows, such that if there was an injured passenger, the rest of the ride could not see what was happening inside the emergency carriage 308. Additionally the emergency carriage or any other part of the assembly 300 could be used to carry signage.

Figure 13:
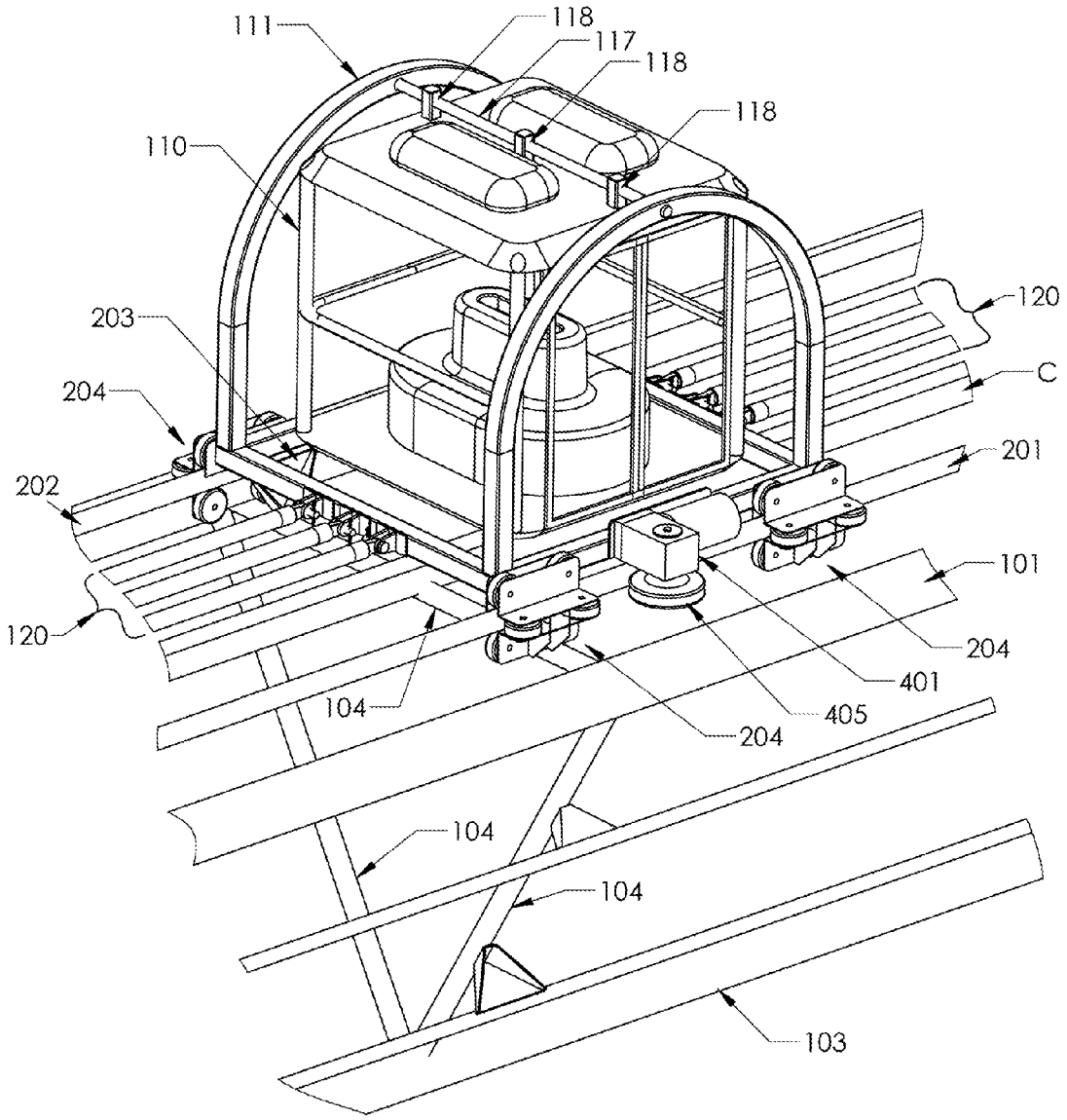
FIG. 13 is a perspective view of the rider carriage with an alternate power mechanism.

FIG. 13 is a perspective view of an alternate means of powering the carriages for the amusement ride 100. Instead of the drive cable, some or all of the support carriages 111 can have a drive mechanism 401 with a motor (not shown) and a wheel 405 that is powered by the motor. The wheel 405 contacts rail 201 and provides the power to move the loop of carriages around the track. Depending on the size of the ride, not all of the support carriages 111 would need to have drive mechanism 401 although it may be desirable to provide all of the support carriages 111 with drive mechanisms 401 as a backup in case of failure of any individual mechanism. If desired, the drive mechanisms 401 can be provided in addition to the drive cable 205 or instead of, depending on the design of the ride. The motors would need to be link either through wiring or wireless communication such that all of the motors could be stopped and started at the same time and to ensure that all of the motors are driving the ride at the same speed to prevent stress on the system.

Figure 14:
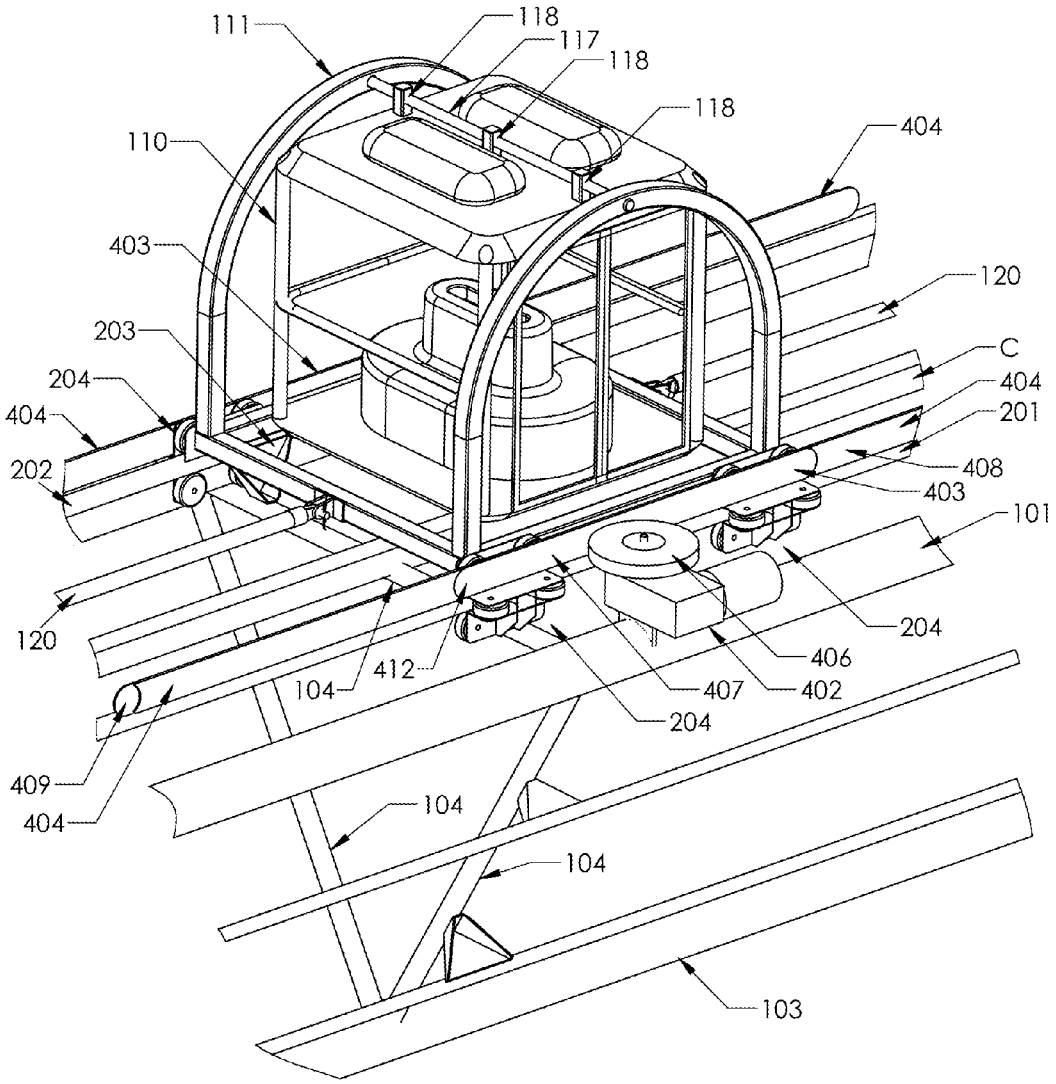
FIG. 14 is a perspective view of a rider carriage with a second alternate power mechanism.

FIG. 14 is a perspective view of another alternate means of powering the carriages for the amusement ride 100. Drive mechanism 402 is mounted on rail 101 of the track S. If desired, drive mechanism 402 could be mounted on both rail 101 and 102, such that the drive mechanism 402 were on both sides of track S. Drive mechanism 402 is powered by motor (not shown) and has wheel 406 which contacts flat link 403 mounted each side of base 115. The flat link 403 has a substantially flat outer surface 407 that contacts the surface of the wheel 406.

Figure 15:
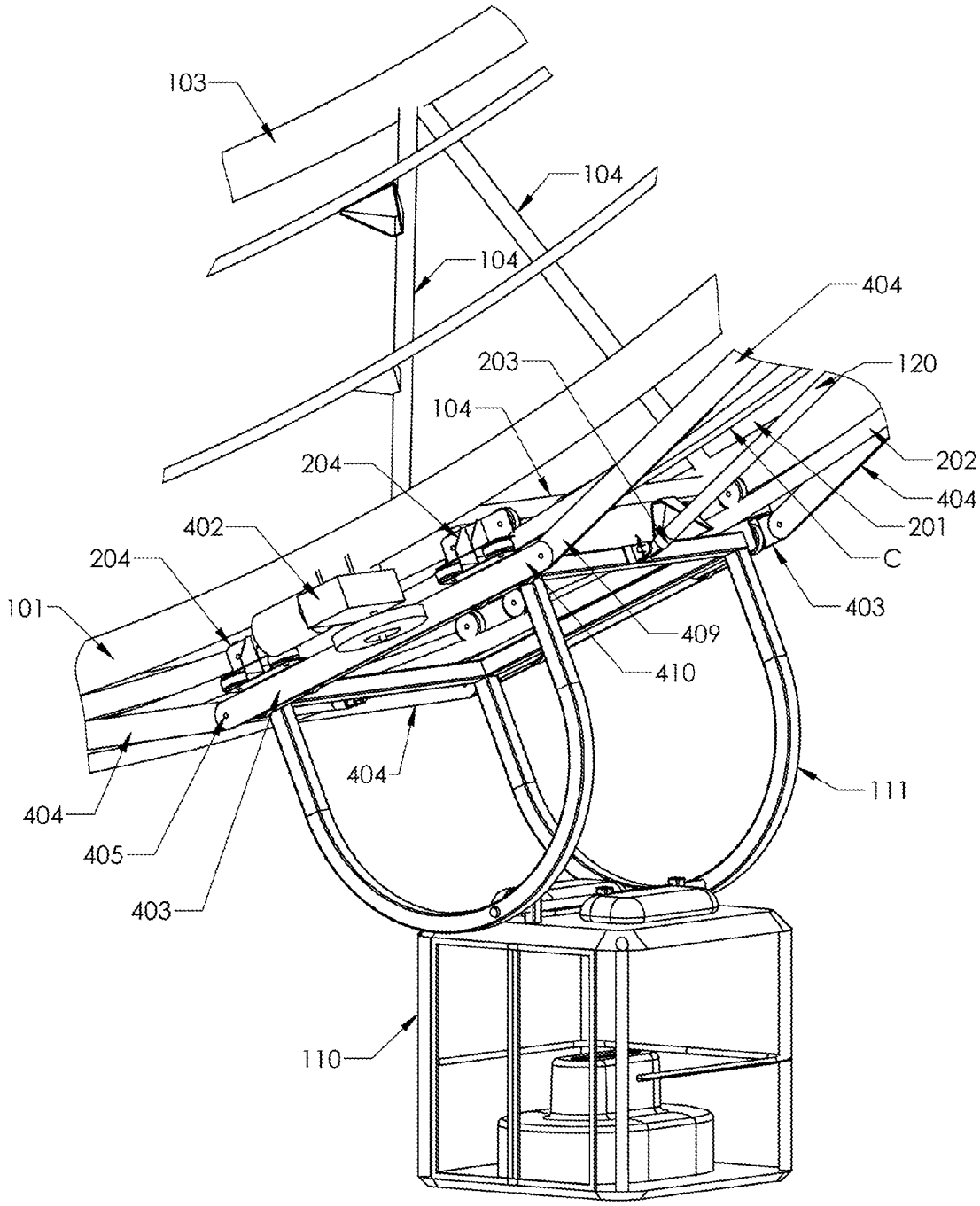
FIG. 15 is a perspective view of the flat link chain on corner.

The flat link 403 is pivotally connected at opposing ends 412 to a second flat link 404 which also has a substantially flat surface 408. In the depicted embodiment second flat link 404 pivotally connects at the opposing ends 409 to the flat link 403 on the next carriage. FIG. 15 shows the flat links turning a corner.

Figure 16:
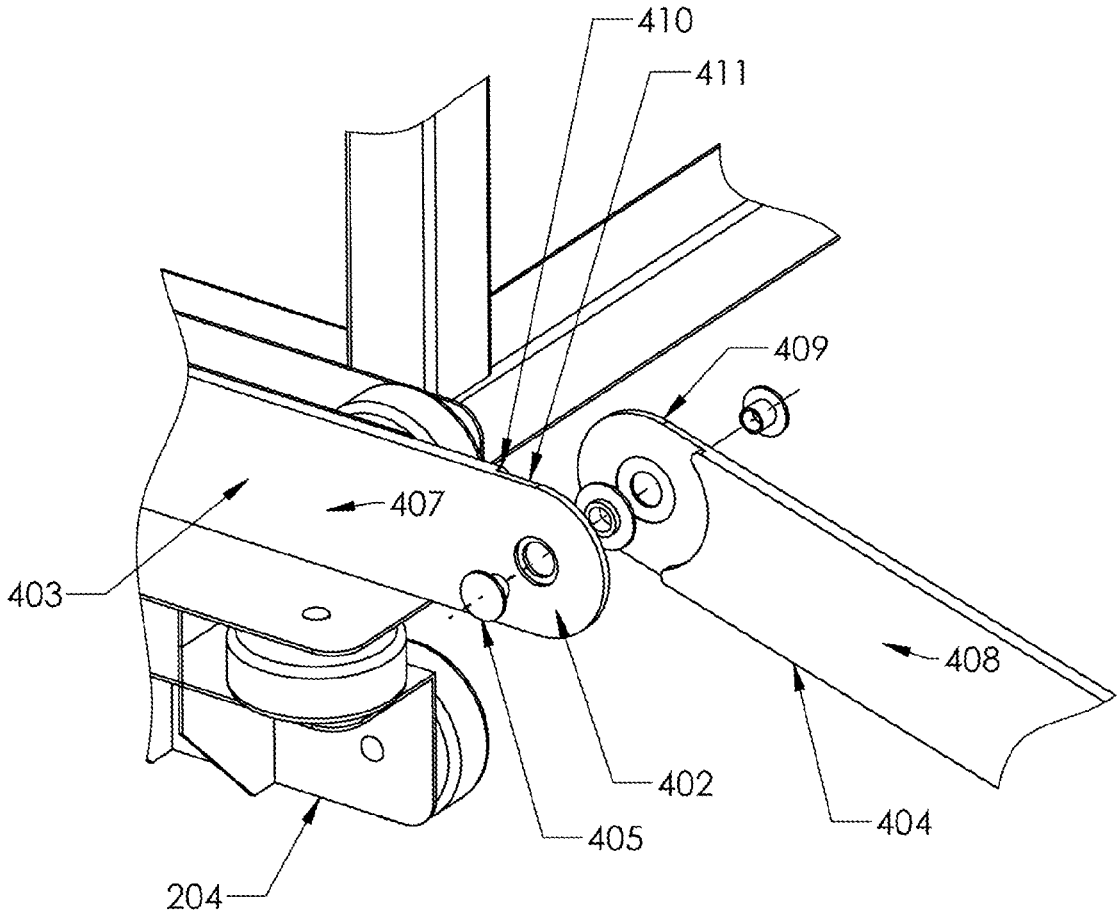
FIG. 16 is an exploded view of the connection of the flat link chain pieces.

FIG. 16 is an exploded view of the pivotal connection between flat link 403 and flat link 404. The flat links 403 and 404 are connected with a bearing 405. The opposing ends of 409 the outer surface 408 of flat link 404 are recessed to allow the two flat links 403 and 404 to be connected together and for the two substantially flat outer surfaces 407 and 408 to form a substantially continuous substantially flat surface for wheel 406. The back sides 410 of flat link 403 have a corresponding recess 411 at opposing ends. There are a number of ways that the flat links 403, 404 could be connected and/or shaped in general. The invention is not limited to the disclosed embodiment of the flat links or pivotal connection. The flat links need to provide a surface to allow the wheel 406 to drive the loop of carriages around the ride, so long as that need is met, any design would work. In some climates, it may be desirable to have some surface texturing on the flat surfaces 407, 408 to reduce the effects of water, frost or ice on the drive efficiency of the ride.

The flat links 403 and 404 form two continuous chains around the perimeter of the ride 100, providing the linkage the three rods 120 provided in the other embodiment. Since the flat links provide two connections on each side of the carriage, it is possible to reduce the number of rods 102 used to link the support carriages 111. In the embodiment depicted in FIG. 14, only one rod 120 is shown. If desired, more could be used. The drive mechanisms 402 are spaced around the perimeter of the track S at desired distances power the wheels 406 which then move the chain of flat links 403, 404, moving the connected loop of carriages around the track. The drive mechanisms 402 are in communication with each other and a control center (not shown) to ensure that all of the wheels 406 are being driven at the same speed and stopped and started at the same time.

In both the embodiments of FIGS. 13 and 14, the drive motors also have braking mechanisms (not shown) to allow the ride to be slowed and halted as needed.

Figure 17:
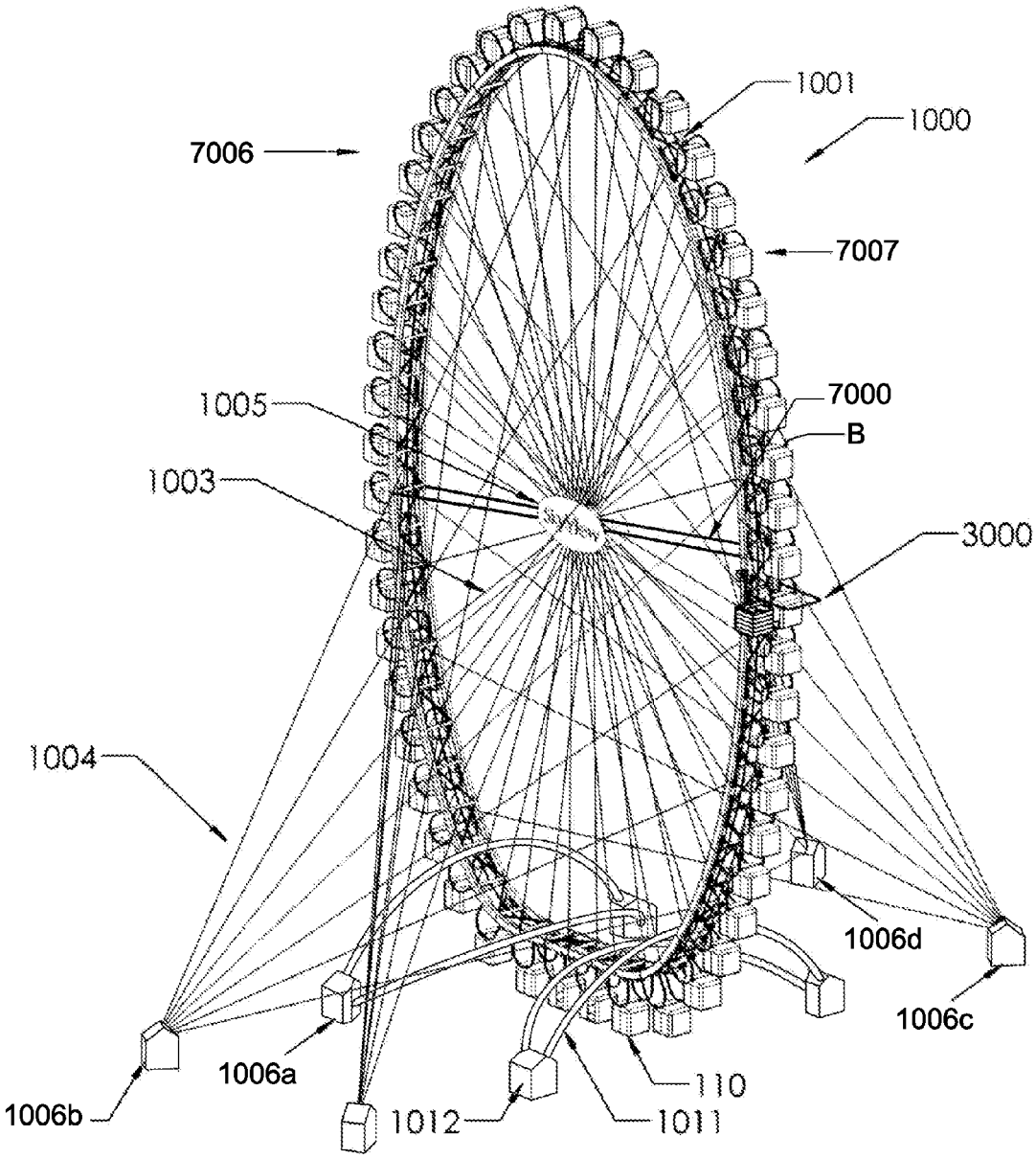
FIG. 17 is a perspective view of a second embodiment of the amusement ride track.
Figure 18:
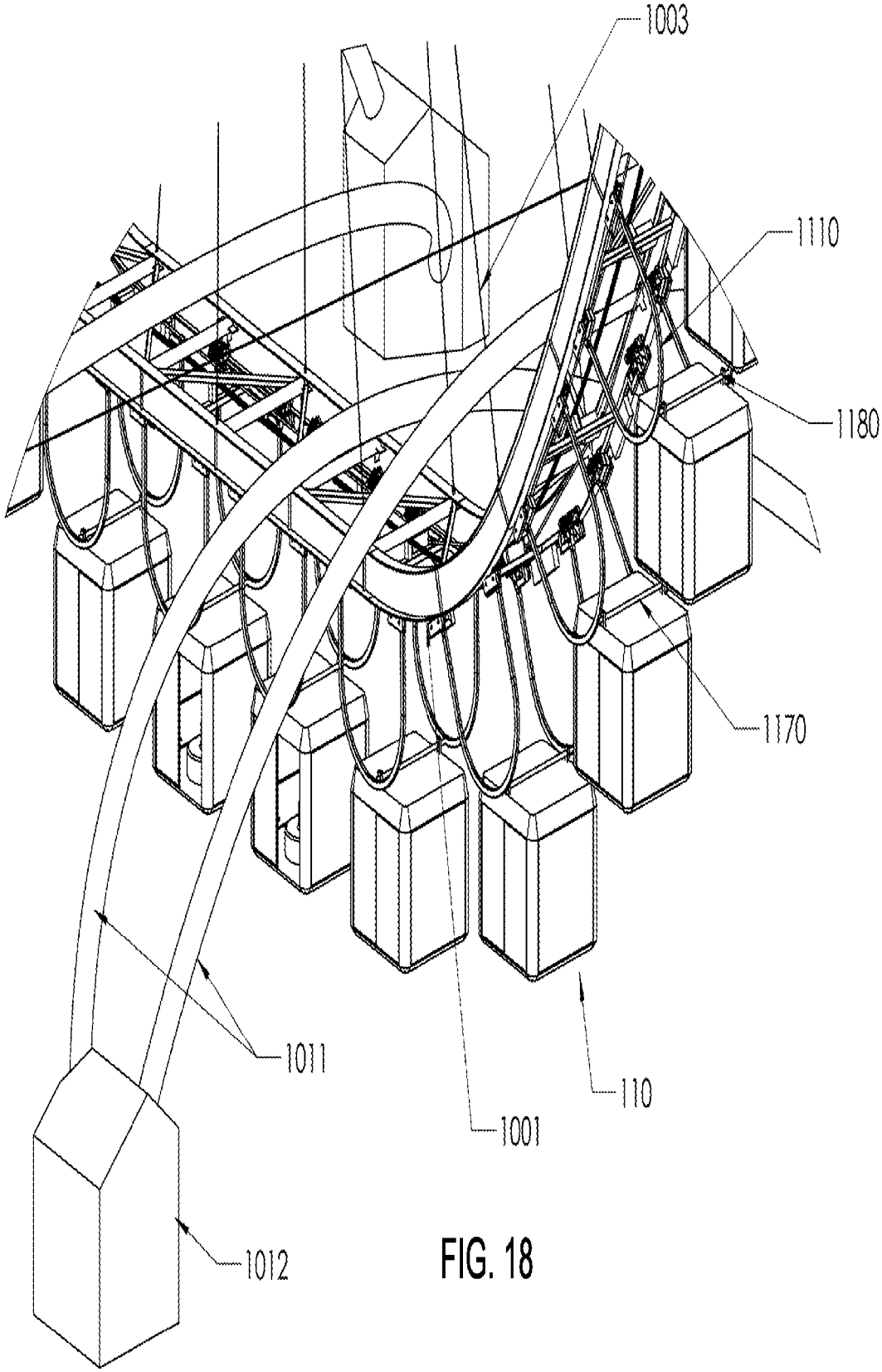
FIG. 18 is a perspective view of the bottom of the second embodiment with the rider carriages.
Figure 19:
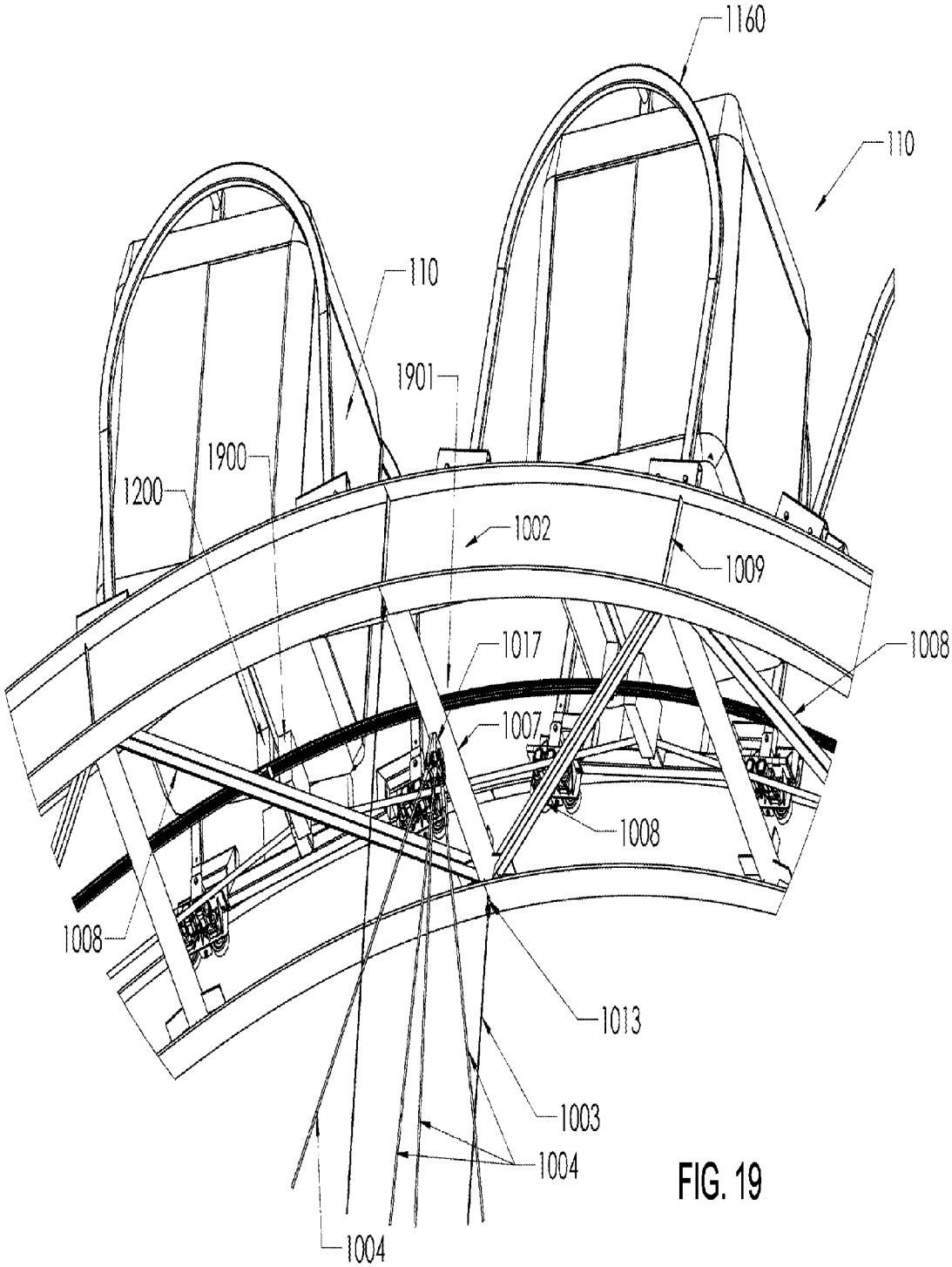
FIG. 19 bottom perspective view of the rider carriages on the top of the second embodiment track.
Figure 20:
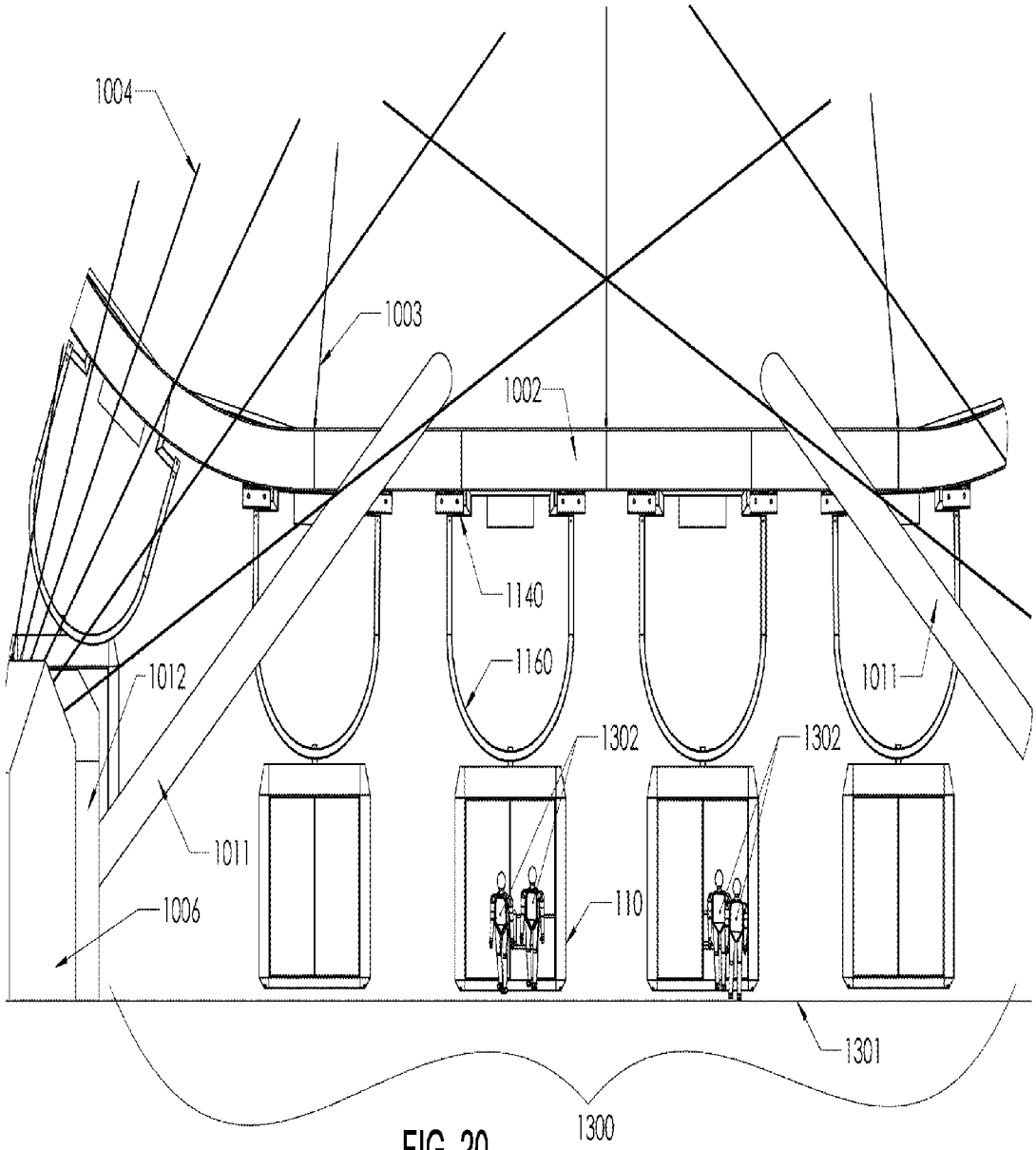
FIG. 20 is a perspective view of the loading area.

FIG. 17 is a perspective view of an alternate embodiment of track construction. In the depicted embodiment of the amusement ride 1000 the track 1001 is made of deep plate girders 1002 having an I cross section. Support legs 1011 are attached to track 1001 and to support leg anchor points 1012, as seen in FIGS. 18 and 20. The support leg anchor points are attached to and/or formed as part of foundations sufficient to support the track structure. The size and depth of the necessary foundations will depend on the size and weight of the overall ride and the location the ride is to be erected. Two sets of plate girders 1002 form the rim structure of track 1001 and in the depicted embodiment are spaced about 14 feet (4.3 meters) apart. The girders 1002 are laced together with cross braces 1007 and diagonals 1008 to make a truss, which is 14 feet deep (4.3 meters) in the depicted embodiment of FIG. 19. A large number of possible configurations of cross bracing structures could be used to connect the girders 1002, no limitation should be inferred from the depicted configuration. The plate girders 1002 are welded together at webs 1009. The advantages to this configuration over the tri-cord truss shown in the other embodiments include: more traditional and simpler fabrication, reducing cost and yielding an increased pool of capable fabricators; reducing cross-sectional depth, which allows longer shop fabricated pieces, reducing shipping and erection time and costs; and allowing the depths of the girders to be easily varied, so that the girders 1002 can be strengthened at higher loads and have their strength reduced where demands are lower. The curving geometry of the girders can be generated by cutting a curved web plate 1009 and welding the flanges to the appropriately curved web, possibly eliminating the need for rolling or curving any members if desired.

The track 1001 is supported and stiffened with connecting cables 1003 and stay cables 1004. The connecting cables 1003 connect to the track 1001 and the hub 1005. The stay cables 1004 attach to ground anchors 1006, of which there are four in the depicted embodiment. As shown in FIG. 19, the connecting cables 1003 attach to the plate girders 1002, one on each side at connection points 1013, increasing the stance of the cables 1003 attached to the rim structure in comparison to the tri-cord truss structure. The connecting cables 1003 serve to brace the plate girders 1002 in the plane of the closed loop frame. There is a pair of connecting cables 1003 at each connection point 1013, one for each of the plate girders 1002 in the depicted embodiment. The exact number and location of the connection points 1013 will depend on the size of the ride and the length of the plate girders. The connecting cables function as spokes and are oriented radially, with most or all cables coming together at the hub 1005 located at approximately mid-height of the overall structure.

The hub 1005 is an epoxy coated steel structure that is about 10 feet (3 meters) in diameter and about 10 feet (3 meters) long in the depicted embodiment. A sign can be attached to each end of the hub 1005. The hub 1005 has a hatch (not shown) to access to the interior for cable tensioning purposes. The interior of the hub can house lighting control panels. The hub can have a hoist or davit crane system (not shown) to lift tools and materials to the hatch. Ladder access from the bottom of the rim to the hub hatch can be provided via a ladder mounted between one set of spoke cables (not shown).

On each side of the track 1001, there are also stay cables 1004 that provide lateral support to the structure and brace the track 1001 out-of-plane, as best seen in FIG. 17. A pair of stay cables 1004, one pair in each direction, is connected to the track 1001 at every other connection cable location one the cross braces 1007 at plates 1017 around the closed loop frame in the depicted embodiment as best seen in FIG. 19. Two cables 1104 are attached at plates 1017 in the depicted embodiment. The number and exact location of these stay cable 1004 will vary depending on the height and geometry of the overall structure. The number of stay cables 1004 should allow for failure of a certain number of stay cables 1004 without affecting the overall stability of the structure.

Both the stay cables 1004 and connection cables 1003 are pre-stressed with an initial tension to remove the sag due to the self weight of the cable, which serves to stiffen the cable. The relationship between the amount of force in a cable and its axial stiffness is such that there is a steep drop-off in cable stiffness once the force in the cable drops below 25% of its design capacity. Therefore, it is recommended that the stay cables 1003 have a minimum pre-stress force of roughly 40% of their design load to avoid the rapid decrease in stiffness as cables are unloaded on the leeward side of the structure. This pre-stress force may also be higher as required to keep the leeward cables from going slack under wind loading.

The location of the ground anchors for the stay cables were modeled at 20%, 30%, 40%, and 50% of the overall structure height (on each side of the closed loop frame) for various cable diameters. The results of this study show that regardless of cable diameter, a stay cable stance of about 40% on each side of the closed loop frame is optimum for the 300 foot (100 meters), 400 feet (122 meters), and 500 feet (153 meters) structure heights, with 30% being optimum for 200 foot (61 meters). This wider stance minimizes the vertical component of the stay cable forces, which lessens the impact on the rim structure.

In addition to bracing and lateral support, the connection and stay cables also help to relieve some of the demand on the rim structure. Depending on the shape of the closed loop frame, the structure may tend to "flatten out" to a more circular shape, which is resisted through bending of the plate girders. By pre-tensioning the spoke and stay cables strategically in a given track shape the cables begin to act as tension ties which resist the lateral thrust caused by the oval shape effect of the closed loop frame, relieving the bending demands on the plate girders and allowing them to act more as purely compression members.

By strategically employing tensioned cables at the appropriate parts of the frame an embedded tied arch can be created within the frame, allowing a significant reduction in the amount of structural steel needed to form a stable frame. This results in considerable cost savings. The prior art relies on a tensioned ring similar to a bicycle wheel with spokes attempting to share the load equally between the spokes even though the loads are not uniform. The tied arch concept employs larger horizontal tension elements 7000 installed horizontally at or near the mid-point of the frame 1001 and reduced size connection cables 1003 at all other locations where the loads are less, significantly reducing weight and the resulting cost, as seen in FIG. 17.

The horizontal tension cables 7000 could either run as one or more cables from one side of the loop to the other, or could mount into the hub 1005 extending horizontally, so long as the cables are sized and tensioned to take the load of stress and create a functional tied arch within the closed loop of the track 1001. These cables would act as pure tension ties, relieving the plate girder bending stress without having a vertical component penalizing the upper half of the frame. Utilizing these horizontal tension cables 7000, the strain on the other connection cables 1003 is reduced. This reduced tension allows the other connection cables to be reduced in size. The connection cables 1003 can be 10 to 20 percent smaller, 10 to 30 percent smaller, 10-40 percent smaller or 10 to 50 percent smaller than the horizontal tension cables 7000 when this type of construction is utilized.

Currently it is believed that ASTM A-586 spiral strand cable would be most suited for the cables because of its axial stiffness properties. Typically, 1 inch (2.54 cm) diameter strands will be used for connection cables 1003, with the possibility of using larger cables in certain locations where warranted by the force level as noted above. For the stay cables 1004, 1.5 inch (3.81 cm) strands would likely be used for the 200 foot (61 meters) and 300 foot (100 meters) options, while 2 inch (5.08 cm) strands would be more likely for the taller structures due to an increase in overturning forces and a need for greater lateral stiffness.

Figure 17A:
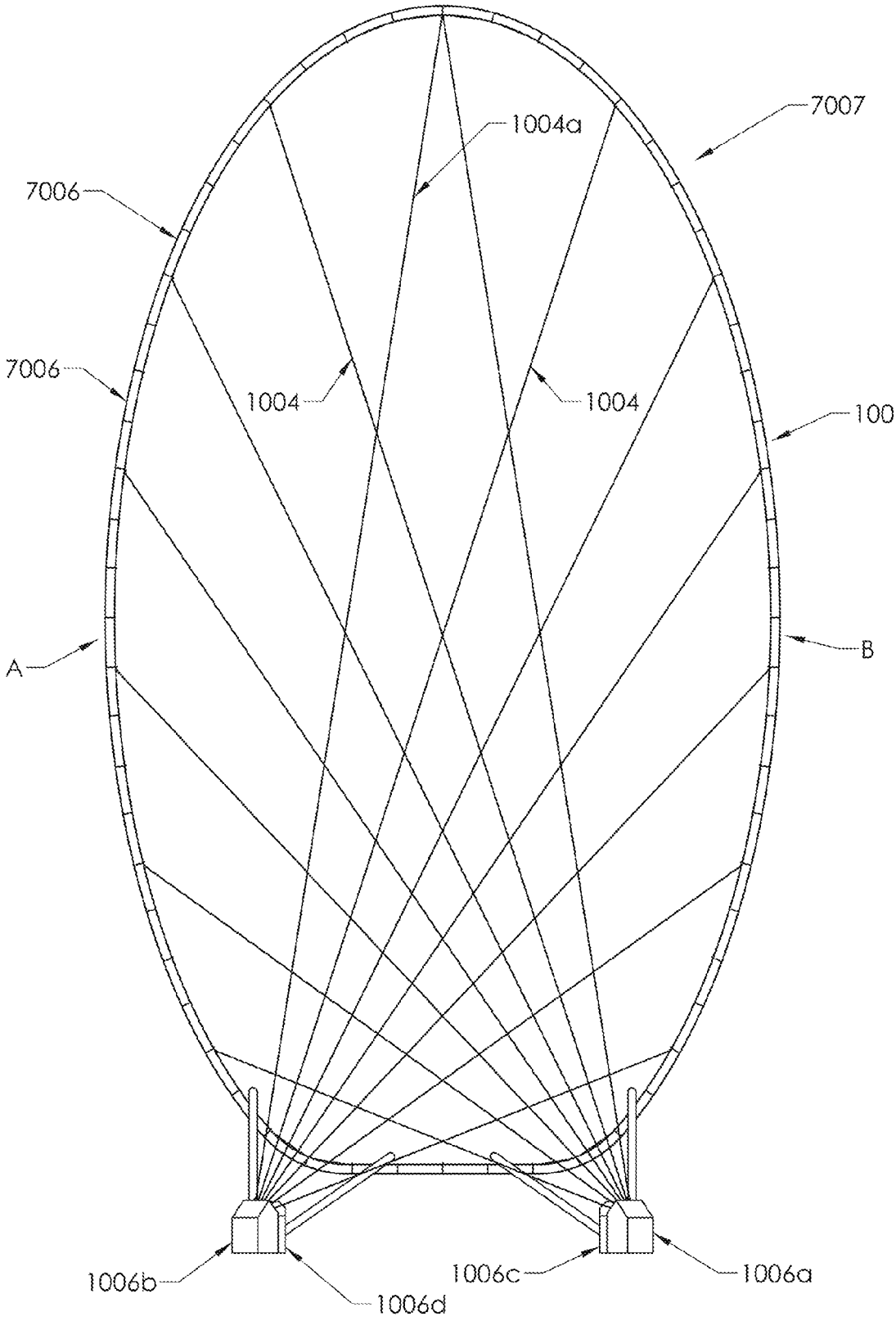
FIG. 17*a* is a front plane view of the second embodiment of the track.

FIG. 17*a* shows the track 1001 with just the stay cables 1004 and the ground anchors 1006 shown. The track has a first face 7006 and a second face 7007 and the rim structure can be vertically divided into a first half A and a second half B. The stay cables 1004 that attach to a given half of the track A are anchored on the ground anchors 1006 on the opposing half of the track B. This means that the stay cables 1004 are cross bracing the frame 1001, not just providing lateral support. This is repeated on the other face 7007. The center stay cables 1004*a* attach at the center top point of the track C. The ground anchors 1006 are spaced apart in a generally rectangular configuration around the rim structure such that two are on the first half side and two are on the second half side. The stay cables that are attached to the first face 7006 and first half A are attached to the ground anchor 1006*a* on the first face 7006 second half B side. The stay cables 1004 being attached to the first face 7006 and second half B being attached to the ground anchor 1006*b* on the first face 7006, first half A side. The stay cables 1004 being attached to the second face 7007 and first half A being attached to the ground anchor 1006*c* on the second face 7007, second half side B. The stay cables 1004 being attached to the second face 7007 and second half B being attached to the ground anchor 1006*d* on the second face 7007, first half A side. This ensures that the stay cables 1004 are cross braced to provide lateral stability and some of the compression load of the rim structure. This provides further stability to the structure.

As seen in FIGS. 18, 19 and 20, the support carriages 1110 have rigid frame 1140 with base 1150 to support rider carriages 110. The rider carriages 110 are the same as the carriages in the other embodiments. Side frames 1160 are mounted to base 1150 on opposing sides of the base 1150. The shape of the side frames 1160 can be chosen for any desired ornamental appearance. Axle 1170 is mounted between the side frames 116 at the top in the depicted embodiments. It is preferable that axle 1170 is mounted at the center top of side frames 116 for even weight distribution over the life of the ride, but this is not required. Rider carriage 110 is mounted on gimbaled bearings 1180 to rotate around axle 1170 as seen in FIG. 18. Each rider carriage 110 can be equipped with a tilt detection system that notifies the operator and shuts the ride down if the floor of the rider carriage 110 exceeds a prescribed slope. The amount of slope to be tolerated can be chosen for each installation of the ride, depending on the desired use of the ride.

Referring next to FIG. 20, in the depicted embodiment the loading area is at the bottom of the ride. The track 1001 can be provide with a flattened section that runs substantially parallel to the ground for a chosen distance to allow a number of rider carriages 110 to have a level path to be available for loading at one time in the loading area 1300. In the depicted embodiment the loading area is about 44 feet (14 meters) long. An Operator Control Station (OCS) (not shown) can be located at the base of the ride at a site with good visual overview of the ride. Closed circuit video surveillance cameras may also be installed if required to provide the operator with a good view of the boarding and disembarkation platforms. A stationary passenger loading platform 1301 runs the length of the loading area 1300 that is substantially level with the floor of the rider carriages 110 as they pass by. In the depicted embodiment the rider carriages 110 do not normally stop moving. Passengers 1302 board the ride 100 by walking along the loading platform 1301 and stepping into the moving gondola in the depicted embodiment. The overall speed of the ride is chosen to allow easy step on and of passengers 1302 at a normal walking speed. The depicted embodiment of the ride 1000 is designed to move the gondolas along the track at about 80 feet per minute (0.9 miles per hour or 0.41 meters per second) in the depicted embodiment.

A set of distance measuring laser sensors (not shown) can be used to monitor the progress of the rider carriages 110 as these pass through the boarding/disembarkation area 1301 and report any over-speed to the Emergency Stop (E-Stop) system. This system can stop the ride in the event of any over-speed conditions. When the ride is fully loaded or evenly loaded the drive can be accelerated to about 135 feet per minute (13.5 meters per minute) for emergency situations. The direction of travel can also be reversed. If a faster ride is desired at a given location, then the ride 1000 could be either stopped for passenger loading or slowed. Passengers 1302 disembark the rider carriages 110 by stepping out of the moving rider carriage onto the loading platform for exiting. If needed ride operator can stop the motion of the ride 1000 to allow loading and disembarking of disabled passengers. The platform 1301 and rider carriages 110 are designed to be wheel chair accessible in the depicted embodiment. The control of passenger access to the loading and unloading area is well known the amusement ride industry and will not be discussed.

The depicted embodiment has a stationary passenger loading platform. If desired integrating a moving sidewalk into the loading platform may be advantageous to allow increased gondola speed and thus increased throughput.

Figure 21:
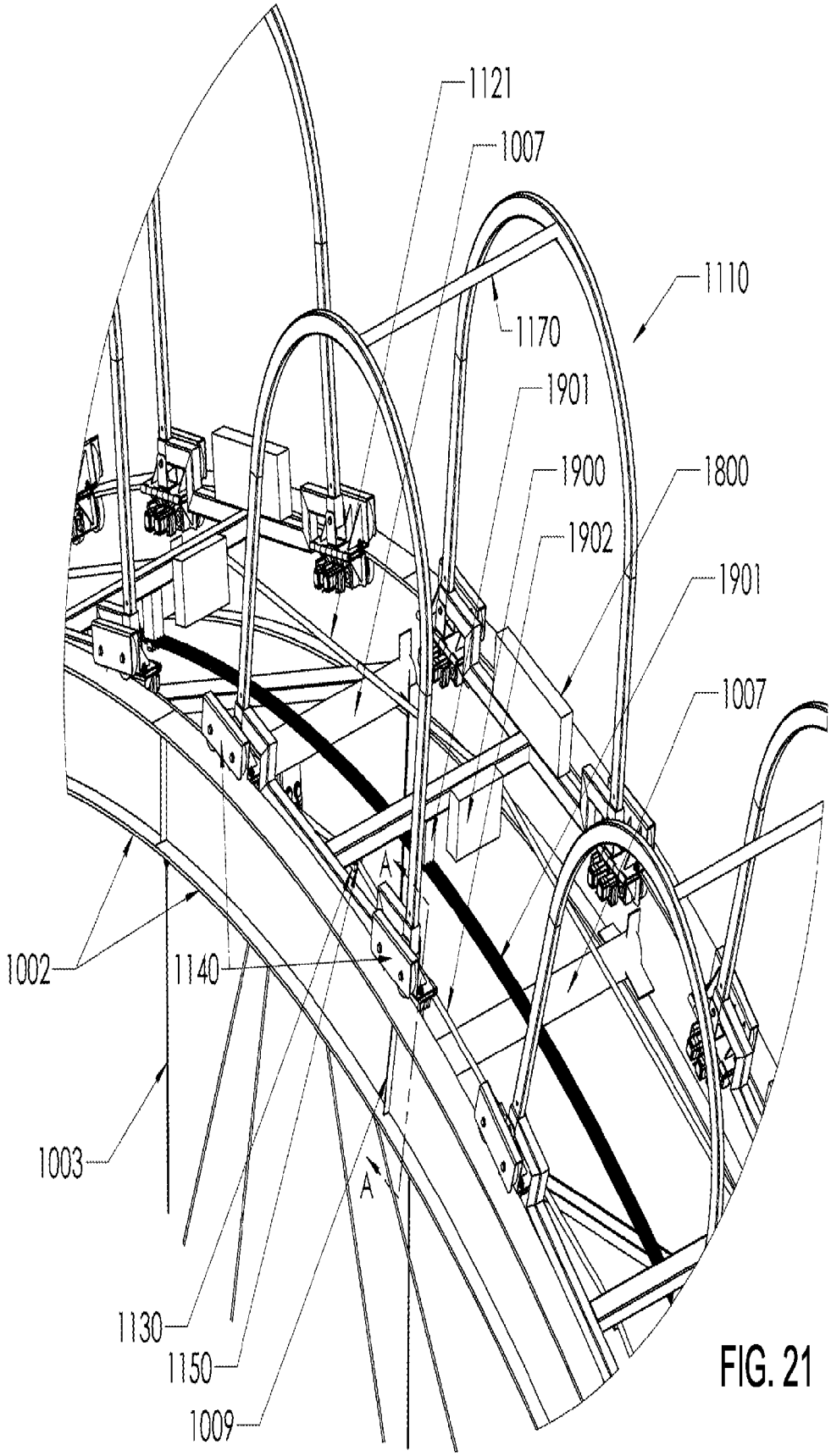
FIG. 21 is a perspective view of the support carriages on the track with the rider carriages removed.

FIG. 21 shows the support carriages 1110 on the top of the track, rider carriages 110 are not shown for ease of viewing. The support carriages 1110 are evenly spaced around the exterior of the closed loop frame. Each trolley is nominally 12 feet (3.7 meters) long and they are spaced about 222 inches (5.6 meters) center to center in the depicted embodiment. As noted above the space of the support carriages 1110 can be varied depending on the installation, so long as sufficient spacing is maintained that the rider carriages 110 cannot come into contact with each other or other support carriages 1110 All of the support carriages 1110 are linked together with at least two tie cables 1120, 1121 that run continuously around the perimeter of the closed loop frame 1001 between the outside surface of the rim structure and the inside surface of the trolley frames. The cables 1120, 1121 are galvanized wire rope in the depicted embodiment. Each support carriage 1110 has a set of clamps 1130 that secures the support carriage 1110 to the cables 120, 1121 such that the support carriages 1110 form a continuous chain around the perimeter of the ride 1000. The continuous chain is tensioned to evenly distribute the load of the chain of gondolas and to reduce the strain on the drive assemblies 1140.

The support carriages 1110 are epoxy coated steel frames about 12 feet (3.7 meters) in length wheel pivot point to wheel pivot point in the depicted embodiment. The support carriages 1110 are constructed in two parts. The base frame 1150 includes the pivoting drive wheel assemblies 1140, trolley drive controls 1800, tie cable clamps 1130, power pick-up assemblies 1120, data pick-up assemblies (not shown), and power distribution panels 1900. A pair of redundant, continuous power feed busses 1901 run around the perimeter of the track 1001. In the depicted embodiment the power feed bus 1901 is 480 volts AC (alternating current). The power feed bus 1901 needs to supply sufficient power for operating the ride; the exact amount of power supplied will depend on the specific installation. The power pick-up assemblies 1902 connect the power feed bus 1901 and then distribute the power to the carriage assemblies via slip-ring assemblies (not shown). Each rider carriage assembly has a power requirement of about 6 kilowatts in the depicted embodiment. The rider carriages 110 can be equipped with interior lighting that can produce adequate lighting at all locations within the rider carriage 110 for purposes of cleaning, servicing, and loading/disembarking at night. The rider carriages 110 are also equipped with lower intensity lighting for the night time ride and viewing. Each rider carriage can have an area standard electrical outlet that can activated only for purposes of servicing or cleaning. The base frame 1150 is connected to the side frames 1160 by four pinned connections discussed below.

The operator control center (OCS) located at or near the rider loading area 1300 can have an industrial computer and monitor running a software program that allows the operator to interact with a Programmable Automation Controller (PAC) also installed at this location. This PAC communicates with an on board PAC mounted on in the rider carriages 110. Data and communications is distributed from this on-board PAC to the OCS PAC via either a wave guide, "leaky cable" system, wireless, or enclosed copper bus bar system. The on-board PAC communicates with the trolley drive controls 1800 and other remote devices and sensors via an industrial Local Access Network (LAN). The PAC monitors and controls all aspects of the ride motion with supervisory input from the software and reports the ride condition back to the operator.

There is one trolley drive control 1800 located on each support carriage 1110 that controls speed of the eight 3 phase 480 volt AC drive motors in the depicted embodiment. The trolley drive control 1800 can also continuously monitor the motor performance and report the status to the PAC and the controller. The trolley drive controls 1800 enable the drive system to accelerate and decelerate at a smooth controlled rate and to accelerate to a higher than normal speed for fast evacuation, should this be necessary.

Figure 22A:
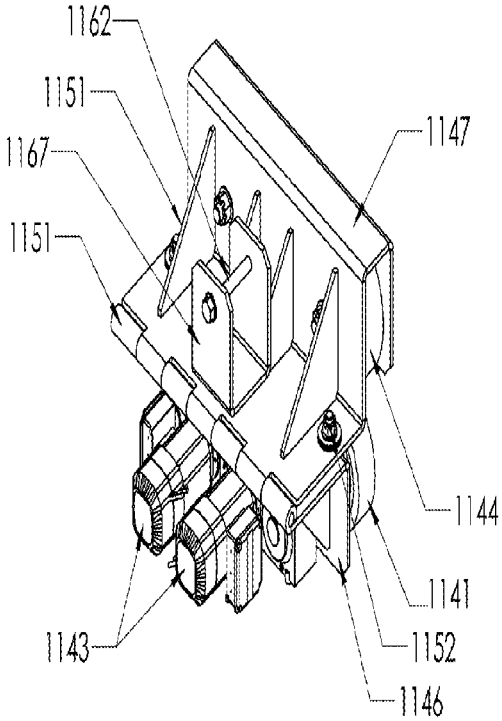
FIGS. 22*a*-22*d* are views of the drive wheel assembly.
Figure 22B:
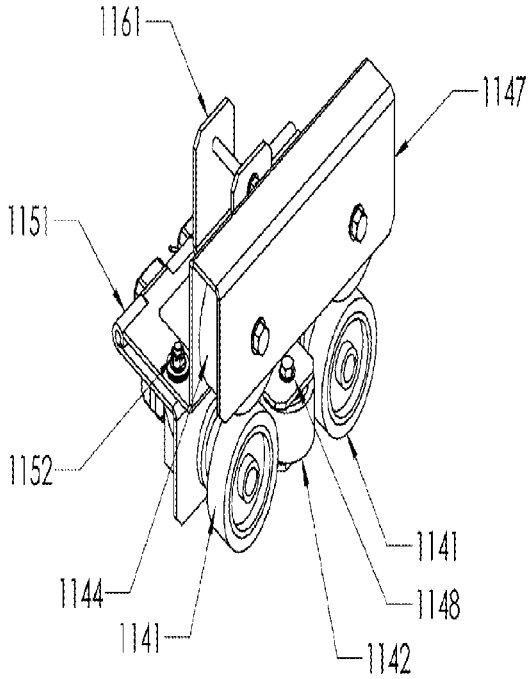
Figure 22C:
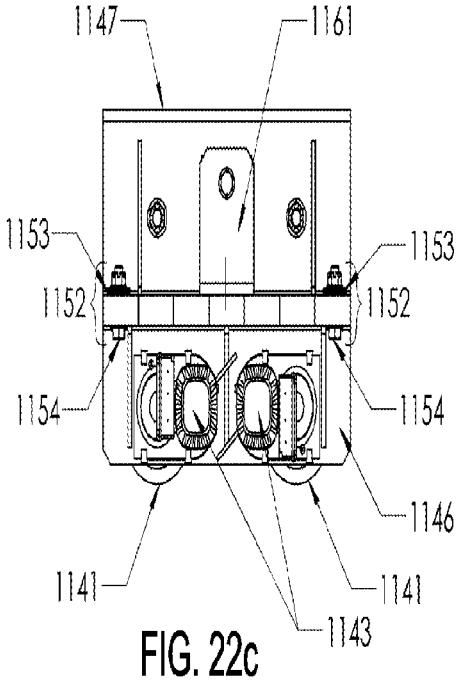
Figure 22D:
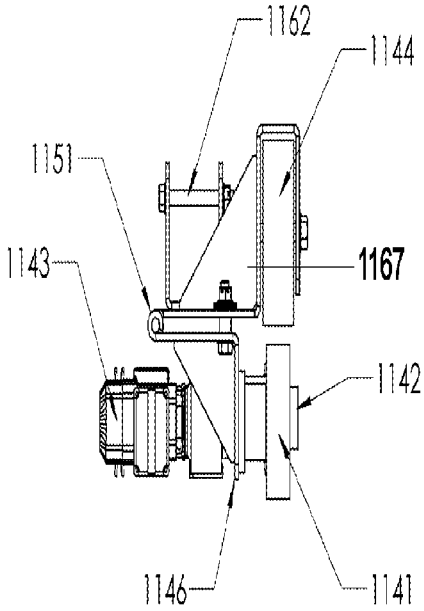

Referring next to FIG. **22*a*-23, the support carriage 1110 have drive wheel assemblies 1140 in each corner of the frame 1150 that ride on the first flange 1022 of the girders 1002 of the track 1001. The drive wheel assemblies 1140 function both to hold the support carriages 1110 on the track 1001 and to provide the drive force to move the ride around the track 1001. Each drive wheel assembly 1140 has a first frame 1147 and second frame 1146 that pivotally connected together at hinge 1151 and compressed together with two pre-stress spring assemblies 1152 in the depicted embodiment. The first frame and the second frame could be connected by means other than the hinge, so long as they can be compressed towards each other as described. A biasing assembly 1153 is placed in the between the bolt 1154 and the first frame 1147 to bias the first frame 1147 toward the second frame 1146. In the depicted embodiment the biasing assembly 1153 is a set of disc spring (Belleville washers) held in place by a bolt, however other known biasing mechanism would function as well. The pre-stress spring assemblies 1152 provide a continuous clamping force that ensures that the drive wheels will have adequate traction available to propel the support carriages 1110 around the closed loop frame under all operating conditions. The trolley base frame 1150 is connected to the first frame 1147 of the wheel assembly 1140 via a pivot pin assembly 1161 with pin 1162, seen best in FIG. 22*a*. Each pivoting drive wheel assembly 1140** consists of five urethane tread wheels in the depicted embodiment.

The drive wheel assembly 1140 must have sufficient structural rigidity to take the stress of the rotational force drive motors 1143 and the weight of the trolley assembly as the ride moves around the track. The various cross bracing 1167 depicted is way to provide such structural rigidity. Other possible configurations of the drive wheel assembly 1140 structure are possible, so long as they provide the necessary stability. There are two 10" (25.4 cm) outside diameter by 3" (7.6 cm) wide, polyurethane tread, traction drive wheels 1141 rotationally mounted on the inner frame 1146 of each wheel assembly 1140 in the depicted embodiment. Each of these drive wheels 1141 is driven by a ¾ horsepower 480 volts AC electric parallel shaft helical gear motor 1143 with brake in the depicted embodiment. This is done to allow for greater redundancy and to ensure that the failure of a single motor does not affect the operation of the ride. In principle, a single motor could be used to drive more than one wheel using a transmission system, but this believed to not be optimal. The four drive wheel assemblies 1140 are controlled by the trolley drive controls 1800 on each carriage. Thus, each rider carriage 1110 has eight drive wheels 1141 and a total drive of six horsepower. The system is designed to remain operational with up to 10 percent of the drives out of service. Each drive wheel 1141 produces about 100 Newtons of drive force for a total drive force of 800 N per trolley. The drive wheels 1141 are oriented to take load radial to the rim curvature and ride on the inside surface 1123 of the first flange 1022 of the plate girders of the rim structure.

The drive wheel motors 1143 are driven by the trolley motor controls 1800 such that the motor speed can be ramped up and down to produce very smooth starts and stops. The VFDs (variable frequency drives) are also used to limit the maximum torque output of the motors to 1.5 times the full load torque output of the motors. Likewise the brakes can be sized to limit the braking and holding force of the drive train. Thus, each drive wheel can generate a maximum of about 150 N of dynamic braking, drive, friction braking, or holding force in the depicted embodiment. Other amounts of force may be needed in other installations, and the motors would need to be chosen appropriately for the installation. No limitation as to the types and power of motors disclosed is intended or should be inferred. The drive system maximum speed is 27 miles per hour when loading and unloading. When the ride is fully loaded or evenly loaded the drive can be accelerated to about 40 miles per hour for emergency situations. The direction of travel can also be reversed. These drive options can be used by the operator to minimize the time required to bring any single passenger back to the passenger platform in the event that they become ill or otherwise need to be retrieved under emergency conditions.

There are a multitude of trolleys with each trolley having eight drive wheels in the depicted embodiment. Thus, this system provides an extraordinary level of drive redundancy. Up to 10 percent of the drives can be disabled and the ride can function normally as depicted. This arrangement provides a highly reliable drive system.

Figure 32:
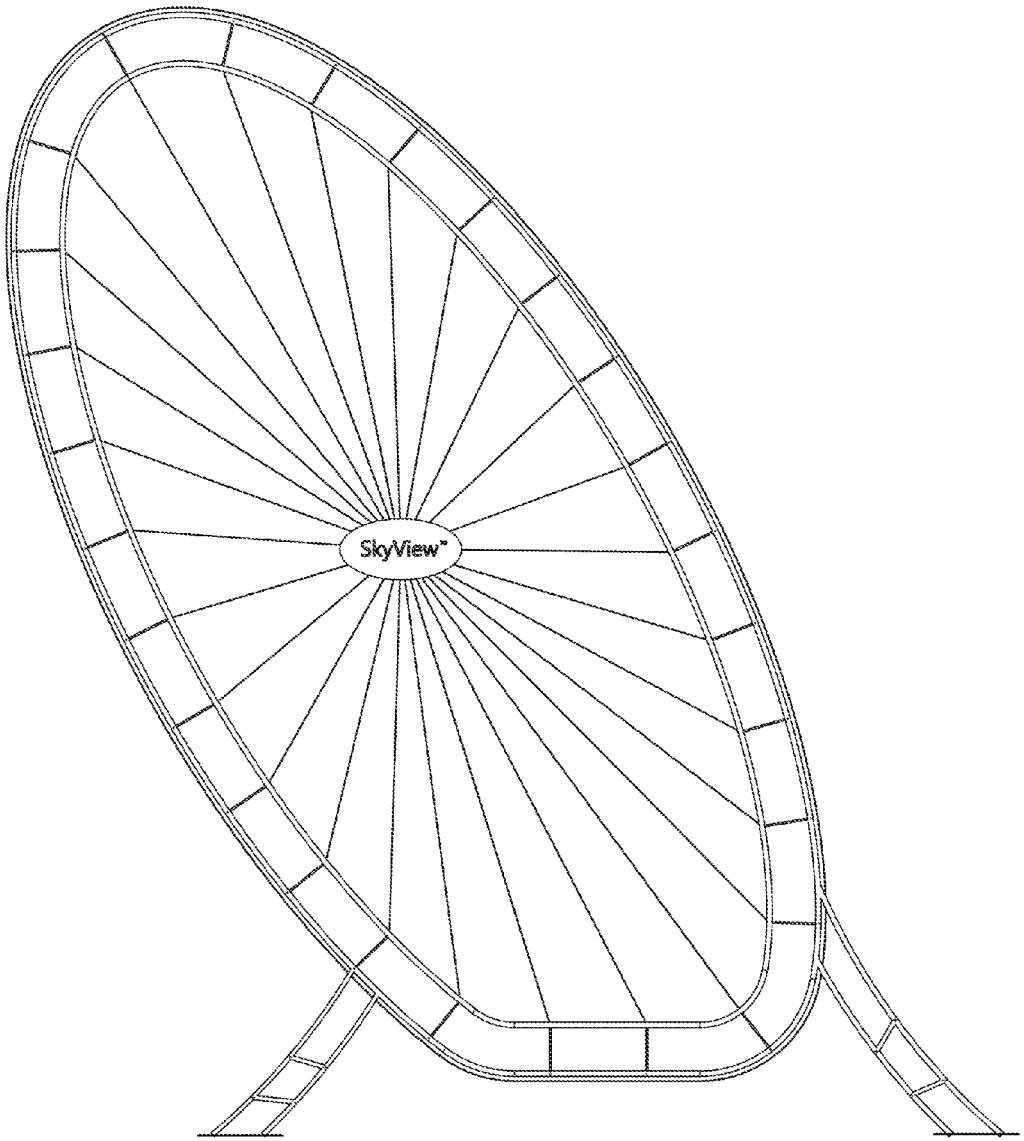
FIG. 32 is a side elevation view of an alternate shape for the track.

There is one approximately 7" (17.8 cm) outside diameter by 4" (10.16 cm) wide, urethane tread, guide wheel 1142 mounted in bracket 1148 on the inner frame 1146 of each wheel assembly 1140 in the depicted embodiment. Other suitable sizes and materials could be used as well; no limitation to the disclosed embodiment is intended or should be inferred. The guide wheel 1142 is located between the drive wheels 1141 in the depicted embodiment. The guide wheels 1142 are oriented to take load perpendicular to the plane of the closed loop frame and ride on the inside surface of the web of the plate girders 1002 of the rim structure. The guide wheels 1142 help to prevent shifts in the load of the frame 1160 from causing the drive wheels 1141 to press up against the plate girders 1002 as best seen in FIG. 32.

There are two 12" (30.48. cm) outside diameter by 4" (10.16 cm) wide, polyurethane tread, radial wheels 1144 mounted in the outer frame 1147 of each wheel assembly in the depicted embodiment. The radial wheels 1144 are oriented to take load radial to the rim curvature and ride on the outer surface 1124 of the first flange 1022 of the plate girders 1002 of the rim structure.

Figure 23:
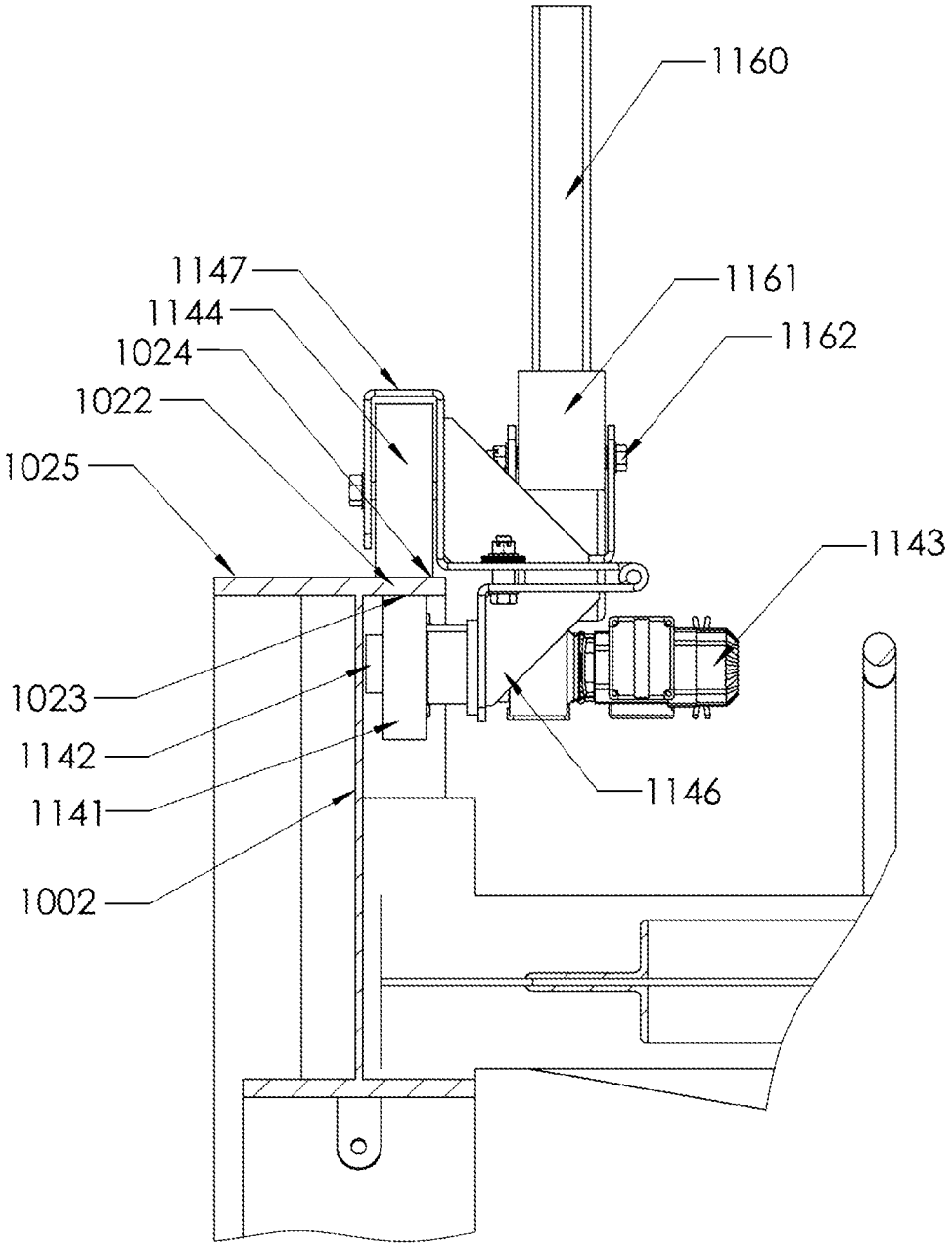
FIG. 23 is a cross section taken along line A-A in FIG. 21 of a drive wheel assembly.

As seen in FIG. 23 the first frame 1147 and the second frame 1146 bracket the first flange 1022 such that the support carriage 1110 is securely supported on the track 1001 regardless of orientation. The pre-stress spring assemblies 1152 compress the first and second frame together to ensure that the wheel 1144, 1141 remain on the first flange 1002 and to ensure traction.

Figure 24:
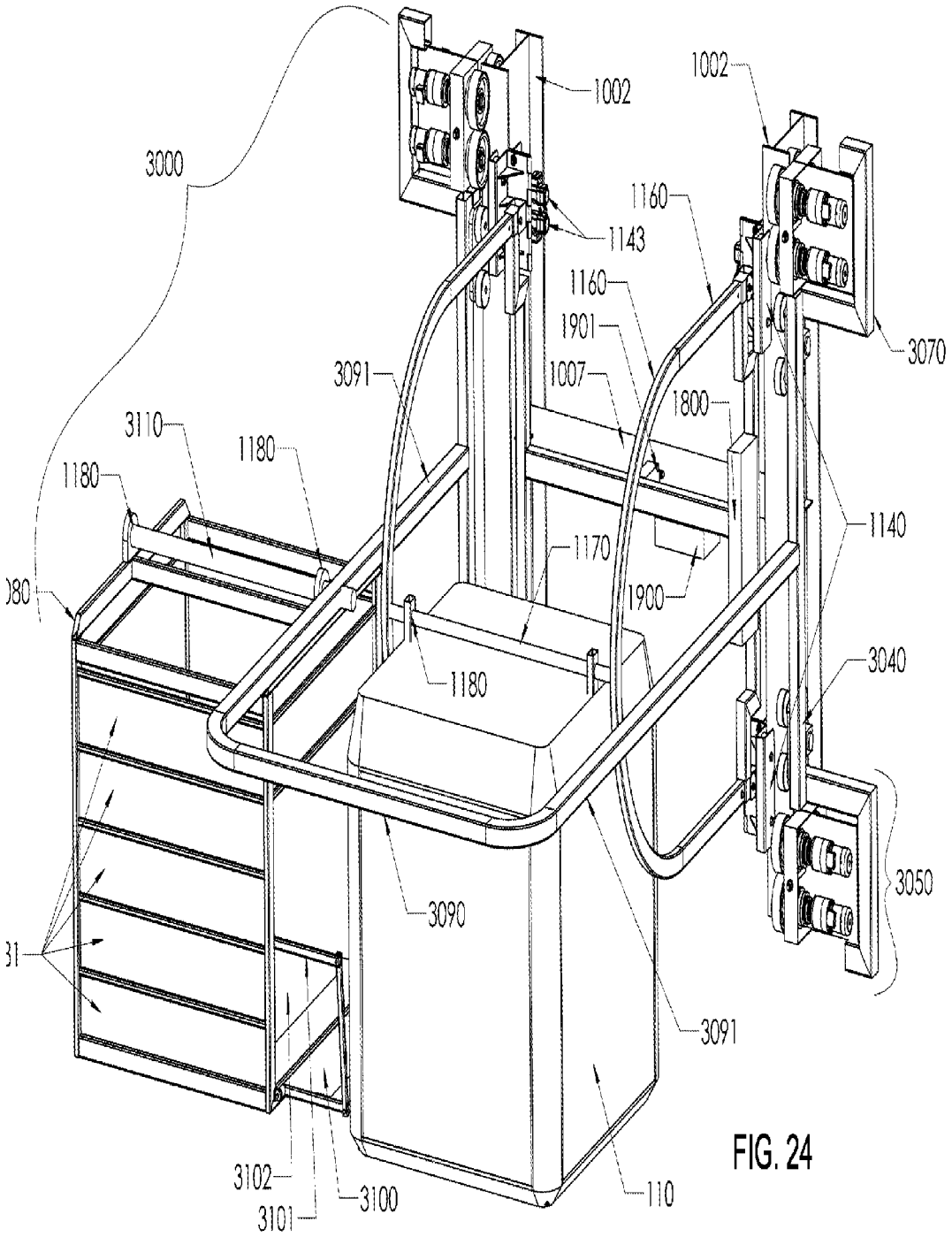
FIG. 24 a perspective view of another embodiment of the emergency access carriage next to a rider carriage on the side of the track.

Referring next to FIG. 24, an emergency access assembly 3000 is provided to allow riders to be evacuated from any given rider carriage 110. A perspective view of the emergency access assembly 3000 is shown next to a rider carriage 110 on the side of the track 1001. This embodiment of the emergency access assembly 3000 rides on the same track 1001 on second flanges 1025 of girders 1002 such that it surrounds the rider trolleys. This allows for simpler track construction. The emergency access assembly 3000 has base frame 3040 with a support frame 3090 with two side bars 3091. A number of possible configurations of the support frame 3090 are possible and no limitation to the configuration of the support frame 3090 should be inferred from the embodiments depicted in the drawings.

In the depicted embodiment the emergency access carriage 3080 has an epoxy coated steel frame that is configured to have its floor surface level with the rider carriage 110 when it is positioned next to the rider carriage 110. The emergency access carriage 3080 is sized to hold 8 passengers and one operator safely in the depicted embodiment. The frame is also coated steel in the depicted embodiment. The base frame 3040 and the support frame 3090 are configured such that the emergency access assembly 3000 does not come into contact with the rider trolleys while the emergency access assembly 3000 moves around the track 1001 or as the emergency access assembly 3000 is being brought alongside the rider trolley.

Figure 25:
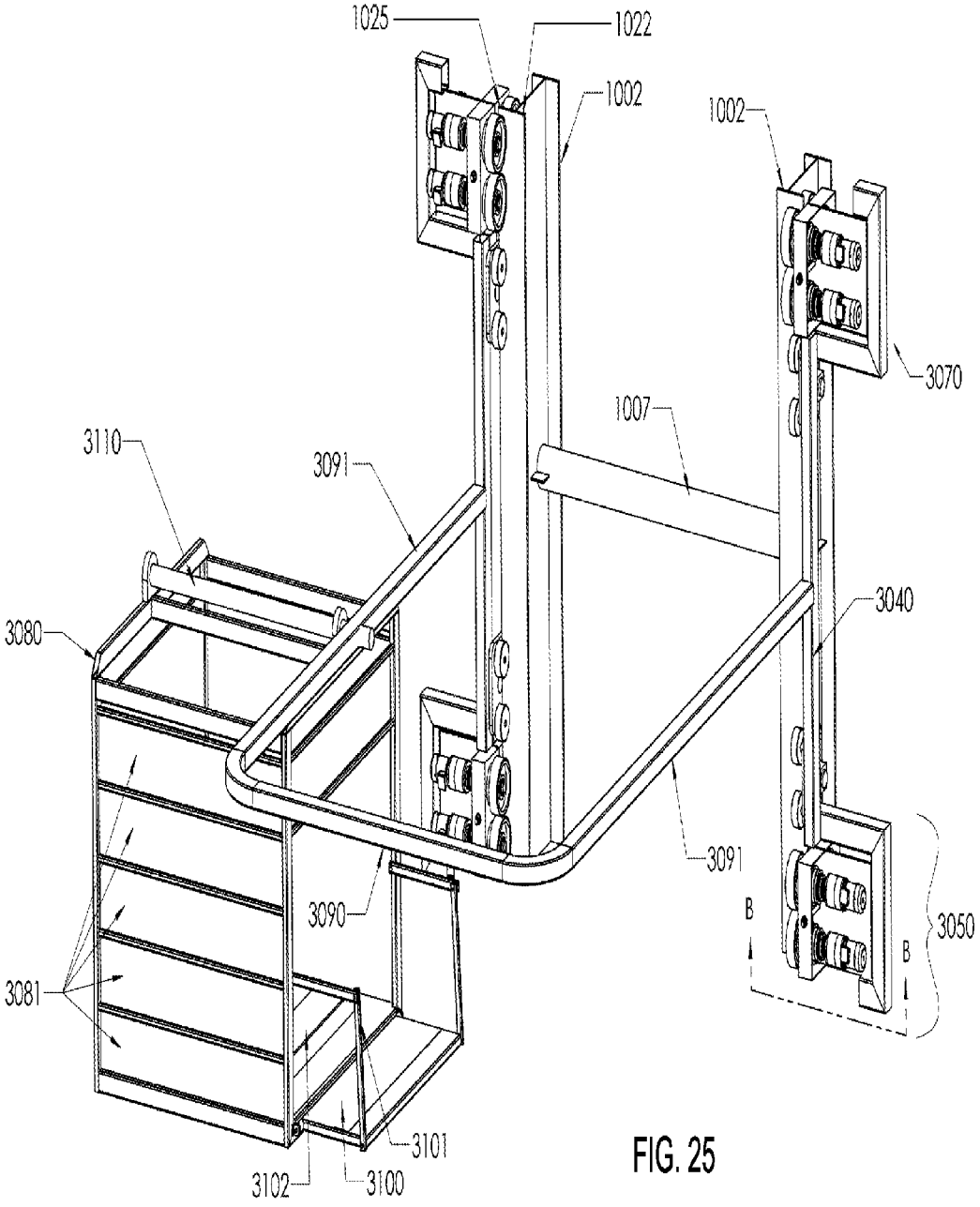
FIG. 25 is a perspective view of the emergency access carriage.

The emergency access carriage 3080 is mounted on axle 3110 on gimbaled bearings 1180. The emergency access carriage 3080 has side panels 3081 in the depicted embodiment. The choice of transparent or opaque side panel 3081 is a purely a design choice and may vary from installation to installation. The axle 3110 extends from the support frame 3090 as can be seen in FIGS. 24 and 25. It is important that the floor 530 of the rider carriage 110 and the floor 3102 of the emergency access carriage 3080 be able to be substantially aligned in a co-planar alignment when they are next to each other. One way to accomplish this is to ensure that the axle 1170 of the rider carriage 110 and the axle 3110 of the emergency access carriage 3080 be at able to be substantially aligned as seen in FIG. 24. This allows the emergency access carriage 3080 to be hanging at the same orientation of the rider carriage 110 when they are both on the side of the track. The emergency access carriage 3080 has a gangplank 3100 that extend from the floor 3102 of the emergency access carriage 3080 to the rider carriage 110. Depending on the configuration of the support frame 3090 the gangplank 3100 may be less than the width of the emergency access carriage 3080 to allow the gangplank 3100 to extend pass the side support bars 3091 to the rider carriage 110. It may be desirable to have more than one gangplank 3100 on the emergency access carriage 3080. The gangplank 3100 can have locking mechanisms (not shown) to lock it to both the emergency carriage 3080 and the rider carriage 110. Extendable guard rails 3101 could be provided as well.

If desired more than one emergency access assembly 3000 could be provided per ride 1000, or the single emergency access assembly 3000 could have an emergency access carriages 3080 on each side of the support frame 3090, possibly allowing two rider carriages to be evacuated, one after another, before returning the loading area to unload the passengers.

Figure 26A:
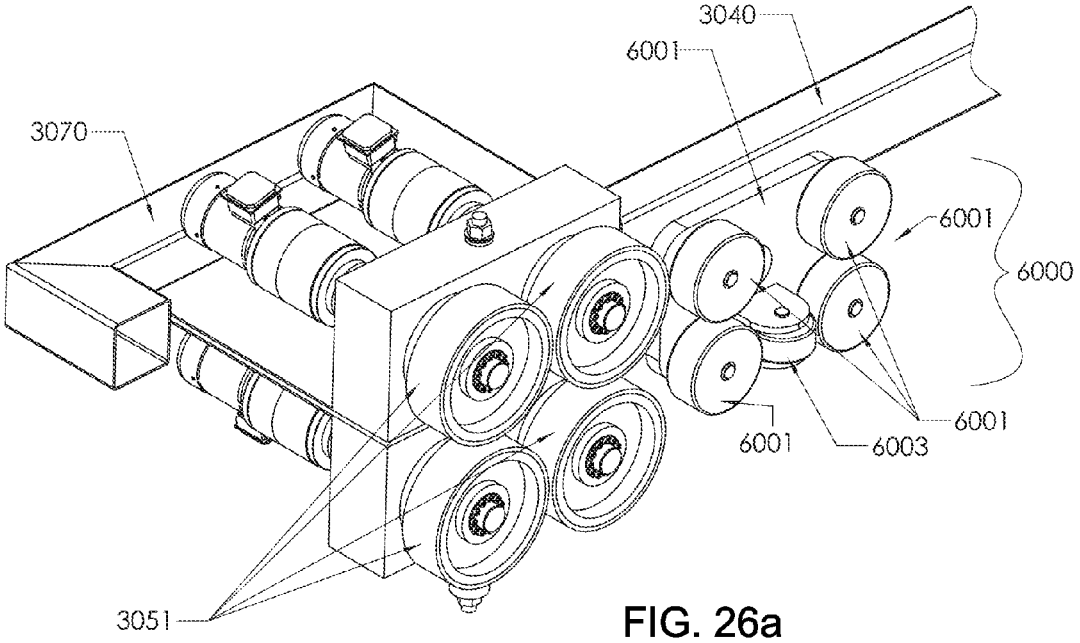
FIG. 26*a-b* are views of the emergency carriage drive wheels assembly.
Figure 26B:
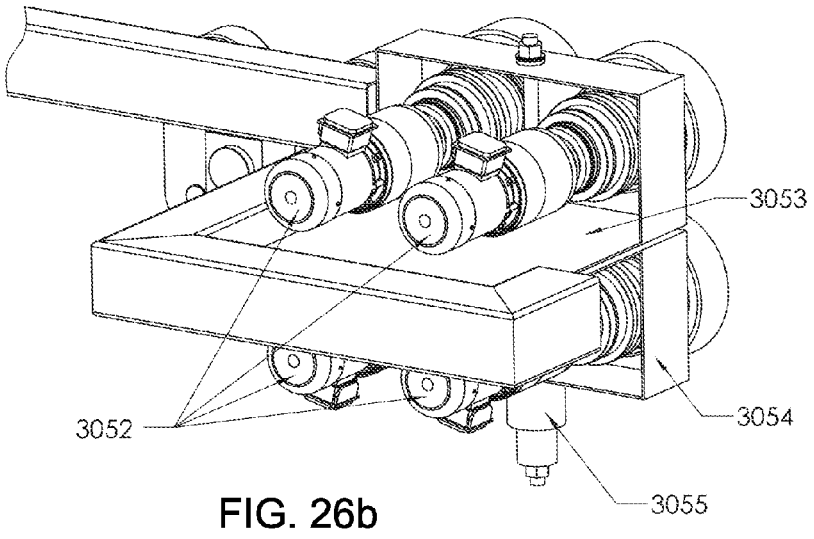

The emergency access assembly 3000 is powered by a completely separate set of drive assemblies 3050 mounted on base frame 3040 seen in FIGS. 26*a* and 26*b*. The emergency access assembly 3000 can have a completely separate power supply from the main drive system, or can be made to be hooked up to emergency generators as needed, depending on the chosen design. It is necessary that some sort of power supply that is not part of regular energy grid be provided, such that the emergency access 3000 assembly could be used in the case of a large scale power outage. In the depicted embodiment the power supply is completely independent from the other ride power. It has its own transformer and feed from the utility. It has its own emergency generator system and transfer switch.

Figure 27:
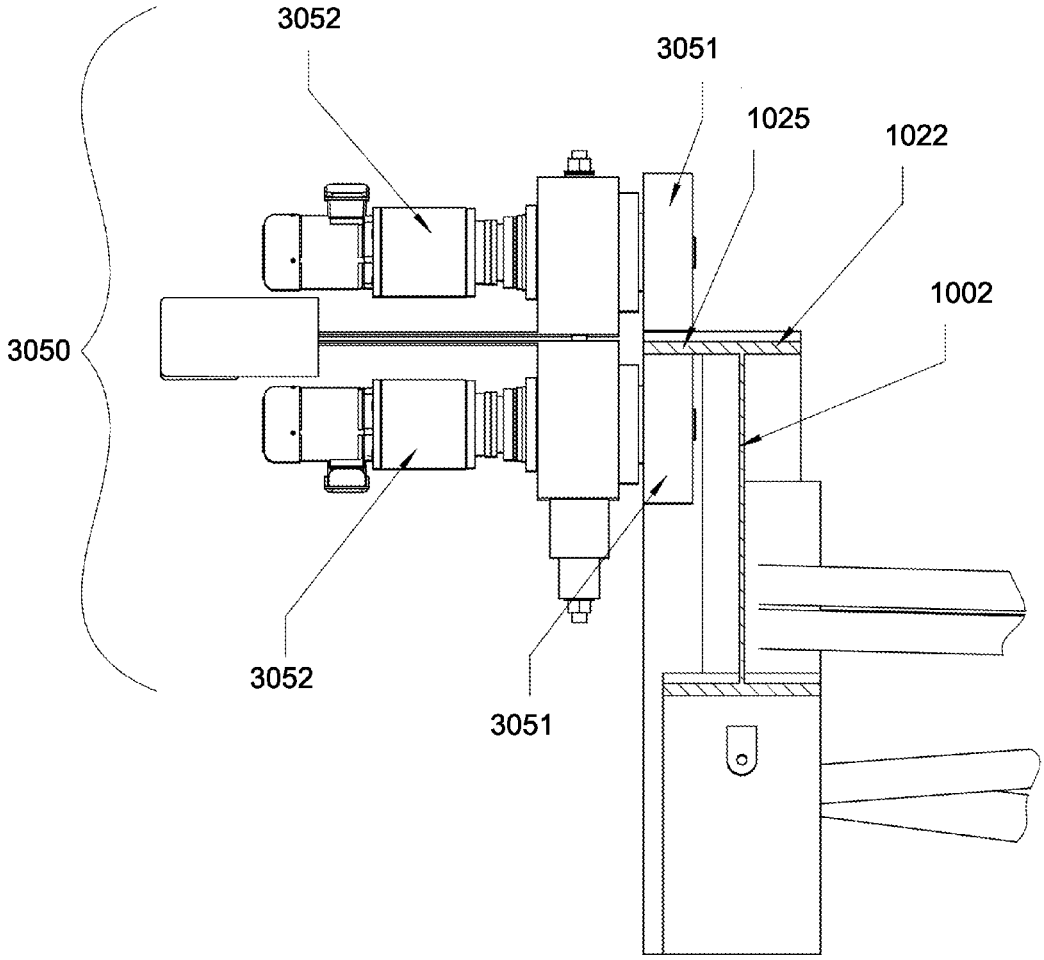
FIG. 27 is a cross section take along line B-B of FIG. 26.
Figure 28:
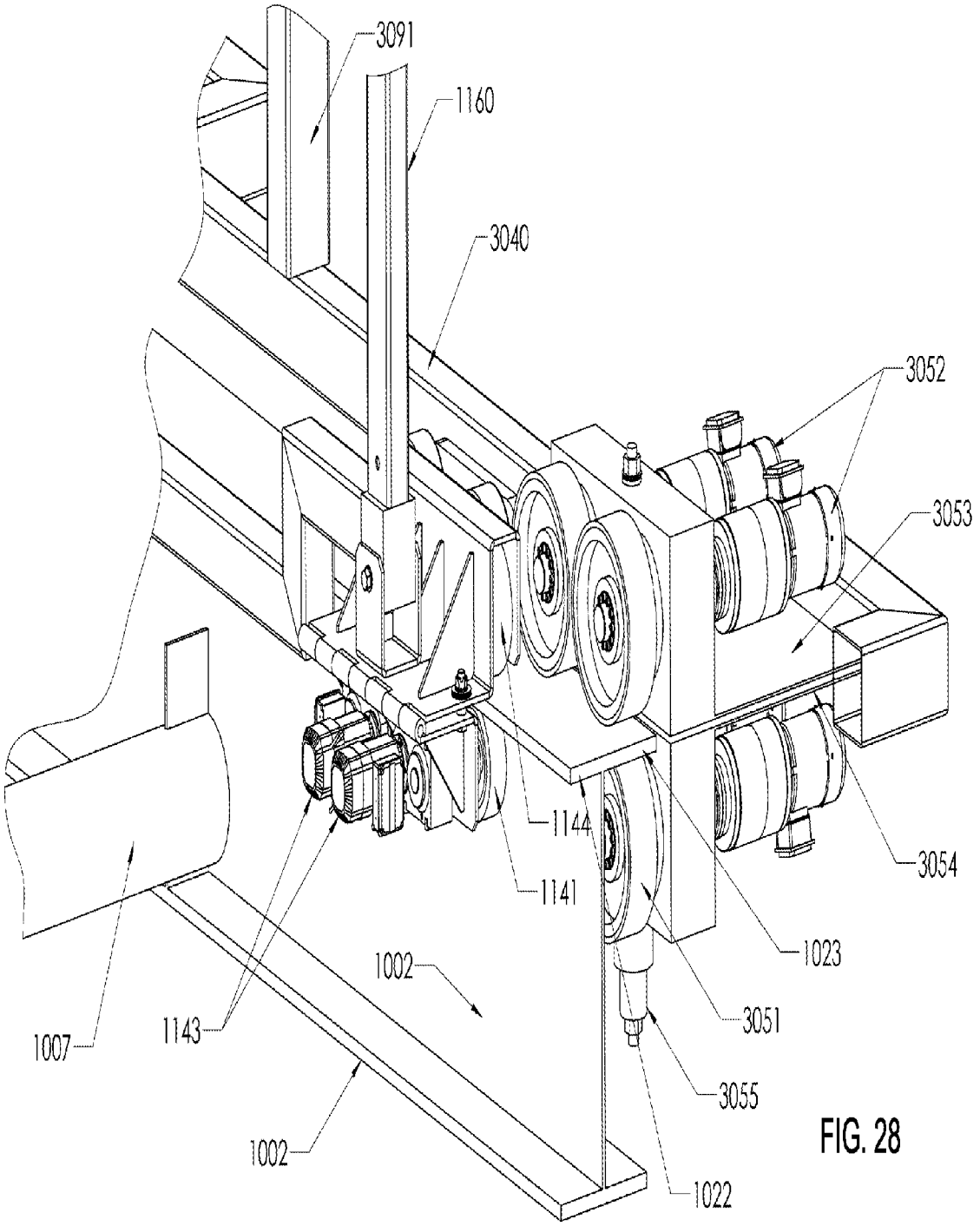
FIG. 28 is a perspective view of the two drive wheel assemblies next to each other on the track.

The support frame 3090 is mounted on to track 1001 on second flange 1025 of girder 1002 with drive assemblies 3050 as seen in FIGS. 27 and 28. In the depicted embodiment the frame 3040 has mounting areas 3070 that extend from the frame. The drive assemblies 3050 are mounted in the mounting areas 3070. There are many ways to mount the drive assemblies on to the base frame 3040 with sufficient stability to function as described. No limitation of the configuration of the base frame and the mounting areas should be inferred from the embodiment depicted in the drawings. The drive assemblies 3050 have four driven wheels 3051, two on each side of the flange 1025 in the depicted embodiment. It is also possible to design the drive assemblies with driven wheels on a single side, as is shown in the drive assemblies for the rider carriages. Each driven wheels 3051 is directly powered by a motor 3052 in the depicted embodiment. This is done to allow for greater redundancy and to ensure that the failure of a single motor does not affect the operation of the emergency access assembly 3000. In principle, a single motor could be used to drive more than one wheel using a transmission system, but this believed to not be optimal. In the depicted embodiment the motors are 20 hp planetary gear motors. Different strength motors may be needed in other installations, and the motors would need to be chosen appropriately for the installation. No limitation as to the types and power of motors disclosed is intended or should be inferred.

The motors and wheels are mounted in a first frame 3053 and second frame 3054 which are attached to the base frame 3040 of the emergency access assembly 3000. The frames 3053 and 3054 are held together by compression unit 3055 seen in FIGS. 26*b* and 28. The compression units 3005 provided the force to press the opposing wheels against the girder flange 1025 as described above. The drives 3052*s* are controlled by an on-board operator from within the emergency access carriage 3080. The maximum drive speed for the trolleys is 160 fpm in the depicted embodiment. Power for these drives is picked up from a continuous power feed bus loop mounted to the side of the rim structure (not shown).

Idler wheel set 6000 is behind the driven wheels 3051 in the depicted embodiment. The idler wheel set provides the counter balance to the forces created by the compression of the driven wheels against the track 1001 and provide for greater stability of the frame 3090. In the depicted embodiment there are four 10" (25.4 cm) outside diameter by 3" (7.62 cm) wide, polyurethane tread, radial wheels 6001 mounted on plate 6002 in the depicted embodiment. The radial wheels 6001 are oriented to take load radial to the rim curvature and ride on the outer surface 1124 of the second flange 1025 of the plate girders 1002 of the rim structure. A guide wheel 6003 is located between the radial wheels 6001 in the depicted embodiment. The guide wheels 6003 are oriented to take load perpendicular to the plane of the closed loop frame and ride on the outside surface of the web of the plate girders 1002 of the rim structure. The guide wheels 6003 help to prevent shifts in the load of the frame 3040 from causing the drive wheels 3051 to press up against the plate girders 1002

FIGS. 29 through 32 show various possible ornamental shapes that the present disclosure allows the amusement ride 100 to be made in. Prior art Ferris wheel type rides did not allow for such a diversity of shapes.

Figure 33:
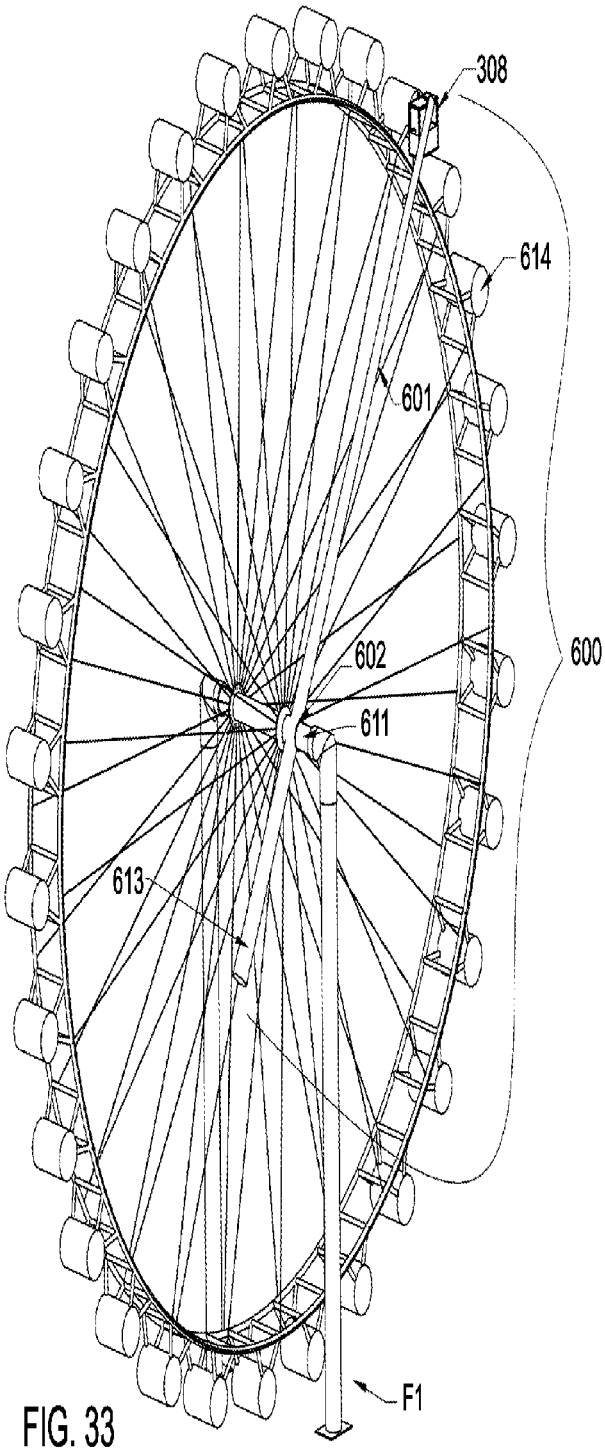
FIG. 33 is a side perspective view of a prior art Ferris wheel with an emergency access assembly mounted on the center axle.
Figure 34:
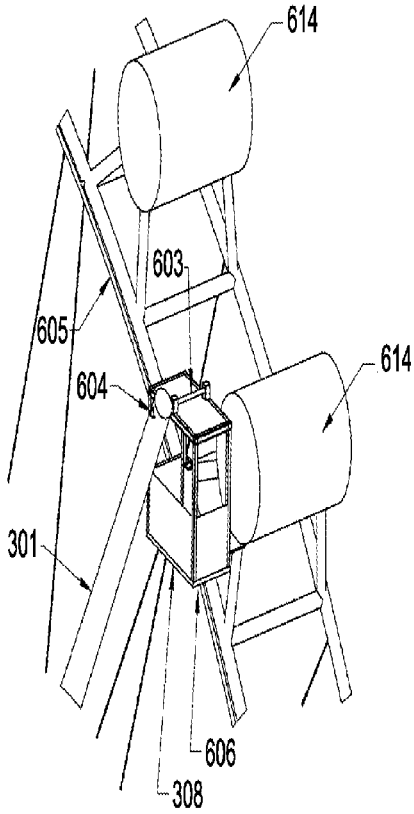
FIG. 34 is a side perspective view of an emergency access carriage next to a rider carriage.

The emergency access carriage 308 discussed above can be used with prior art types of Ferris wheels with some modification, as see in FIGS. 33 and 34. FIG. 33 shows a London Eye type Ferris wheel with an emergency access apparatus 600 to allow the passengers to be evacuated in if the Ferris wheel quits operating. In this type of Ferris Wheel the rider carriage 614 rotates on its own central axis driven by drive motors. The emergency access carriage 308 is mounted at or near one end of pivoting arm 601, which is mounted on central axel 611 of Ferris wheel F1 at rotation point 602. Rotation point 602 contains the necessary bearings and motors to move the pivoting arm 601. On the opposite side of rotation point 602 is counter balance arm 613, which is weighted to put the balance point of the whole emergency access apparatus 600. The balance point is on the counter weight side until the riders board the emergency access carriage. The emergency access carriage 308 is mounted on axle 603 on gimbaled bearings 606. The axle 603 extends from the pivoting arm 601 next to the rider carriages 614 as seen in FIG. 34. The emergency access carriage 308 is further supported by emergency access carriage attachment trolley 606, which rides on emergency access carriage attachment rail 605. The support rail and carriage are optional. The attachment to the support rail is two wheels on either side, pinching the rail or other similar mechanisms.

A gangplank (not shown) is used to connect the emergency access carriage 308 and the rider carriage 614 to allow the riders to transfer to the emergency access carriage 308 during an evacuation. If desired the gimbaled bearings 606 can have locking mechanisms (not shown) to lock the emergency carriage 308 to prevent or reduce motion of the carriages during the rider transfer. Extendable guard rails (not shown) could be provided as well.

Figure 35:
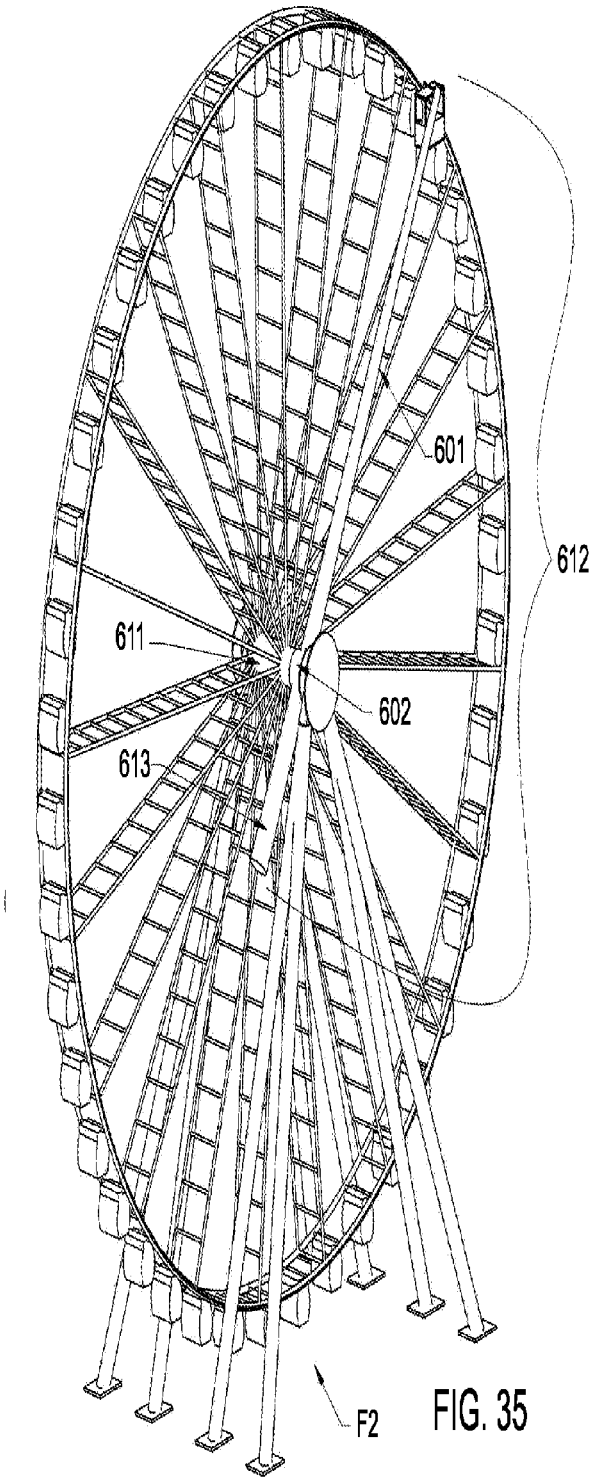
FIG. 35 is a side perspective view of a second type of prior art Ferris wheel with an emergency access assembly mounted on the center axle.
Figure 36:
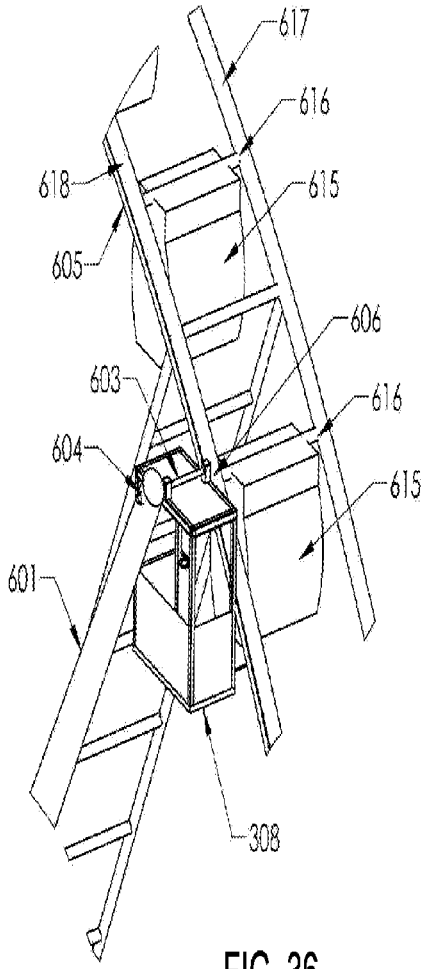
FIG. 36 is a side perspective view of an emergency access carriage next to a second type of rider carriage.

FIG. 35 shows a traditional type Ferris wheel enclosed rider carriages 615 with an emergency access apparatus 600 to allow the passengers to be evacuated if the Ferris wheel quits operating. In this type of Ferris Wheel the rider carriage 615 rotates on axle 616 that extends between frame members 617, 618. The emergency access carriage 308 is mounted at or near one end of pivoting arm 601, which is mounted on central axel 611 of Ferris wheel F1 at rotation point 602. Rotation point 602 contains the necessary bearings and motors to move the pivoting arm 601. On the opposite side of rotation point 602 is counter balance arm 613, which is weighted to put the balance point of the whole emergency access apparatus 600. The balance point is on the counter weight side until the riders board the emergency access carriage. The emergency access carriage 308 is mounted on axle 603 on gimbaled bearings 606. The axle 603 extends from the pivoting arm 601 next to the rider carriages 615 as seen in FIG. 36. The emergency access carriage 308 is further supported by emergency access carriage attachment trolley 606, which rides on emergency access carriage attachment rail 605. The emergency access carriage axle 603 lines up with rider carriage axle 616 in the depicted embodiment.

A gangplank (not shown) is used to connect the emergency access carriage 308 and the rider carriage 615 to allow the riders to transfer to the emergency access carriage 308 during an evacuation. If desired the gimbaled bearings 606 can have locking mechanisms (not shown) to lock it to both the emergency carriage 308 and the rider carriage 615 to prevent or reduce motion of the carriages during the rider transfer. Extendable guard rails (not shown) could be provided as well.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure.

In general the terms and phrases used herein have their art-recognized meaning, which can be found by reference to standard texts, journal references and contexts known to those skilled in the art. The above definitions are provided to clarify their specific use in the context of the invention.

We claim:

1. A vertical wheel type ride comprising:

a stationary rider track forming a closed loop;

a closed loop of rider carriages moveably mounted on the stationary track such that the loop of rider carriages can move along the track for one or more circuits of the track;

an emergency access assembly having an emergency access carriage; and the emergency access assembly mounted on the ride such that the emergency access carriage can be positioned alongside any chosen rider carriage located on any given point of the track such that a rider can be transferred from one carriage to the other.

2. The device of claim 1 wherein the rider carriage and the emergency accesses each have compartment floors that the riders can stand on, the floors of the emergency access carriage and the chosen rider carriage being substantially coplanar when the rider is transferred from one carriage to the other.

3. The device of claim 1 wherein the emergency access assembly is movably mounted on a track that is substantially parallel to the rider track for a majority for the length of the track.

4. The device of claim 1 wherein the emergency access assembly is movably mounted on the same track as the rider carriage loop.

5. The device of claim 1 wherein the emergency access assembly is mounted such that the emergency access assembly passes on one side of the rider carriages without coming into contact the rider carriages.

6. The device of claim 1 wherein the emergency access assembly is mounted such that is surrounds the rider carriages as the emergency access assembly moves past the rider carriages without coming into contact with the rider carriages.

7. The device of claim 1 wherein the emergency access assembly is mounted on a pivoting arm that is mounted a central axle of the ride such that the rider access assembly can be moved alongside any chosen rider carriage by pivoting the arm on the central axle.

8. The device of claim 1 further comprising:

the rider carriages pivotally mounted on a support carriage, such that the floor of the rider carriage remains substantially level as the rider carriages travel around the closed loop track; and the emergency access carriage being pivotally mounted on the emergency access assembly such that the floor of the emergency access carriage remains substantially level as the emergency access assembly travels around the close loop track.

9. The device of claim 8 wherein the rider carriages and the emergency access carriage are pivotally mounted on axles.

10. The device of claim 9 wherein the axle of the emergency access carriage can be axially aligned with the axle of any chosen rider carriage.

11. The device of claim 1 wherein the emergency access carriage further comprises a gangplank that can be extended toward the rider carriage.

12. The device of claim 1 further comprising:

the track having at least one track member having at least one flange having a upper surface and a lower surface;

the rider carriages being mounted on support frames;

the support frames having at least one drive wheel assembly;

the drive wheel assemblies having a plurality of wheels rotationally mounted in a drive frame;

the drive frame having a first frame section and a second frame section;

the drive frame holding the wheels such that at least one of the wheel rides on the upper surface of the flange and least one of the wheels rides on the lower surface of the flange;

the drive frame having a compression means functioning to ensure that at least one of the wheels is in contact with the upper surface while at least one of the other wheels is in contact with the lower surface ensuring that the wheels always have at least some traction on the surface; and at least one of the wheels that has traction being driven by motor such that the motion of the driven wheel moves the rider carriage along the track.

13. The device of claim 12 wherein the drive wheel assembly further functions to hold the support frame on the track as the rider carriage moves along the track.

14. The device of claim 12 further comprising the first frame section and the second frame section bracket the flange.

15. The device of claims 14 wherein a portion of the wheels are mounted in the first frame and the remainder of the wheels are mounted in the second frame.

16. The device of claims 14 wherein the first frame and the second frame are pivotally mounted to each other.

17. The device of claim 16 wherein the frames are pivotally mounted with a hinge.

18. The device of claims 12 wherein the wheels on only one side of the flange are driven by motors.

19. The device of claims 12 wherein the wheels on both sides of the flange are driven by motors.

20. A Ferris wheel type ride comprising:

a wheel mounted on an axle;

rider carriages moveably mounted on the wheel;

an emergency access assembly having an emergency access carriage; and the emergency access assembly mounted on the ride such that the emergency access carriage can be positioned alongside any chosen rider carriage located on any given point of the track such that a rider can be transferred from one carriage to the other.

21. The device of claim 20 wherein the emergency access assembly is mounted on a pivoting arm that is mounted a central axle of the ride such that the emergency access carriage can be moved alongside any chosen rider carriage by pivoting the arm on the central axle.

22. The device of claim 20 wherein the Ferris wheel rotates on a central axis and the rider carriages are pivotally mounted to the wheel.

23. The device of claim 20 further comprising the emergency access carriage being further supported by an emergency access carriage attachment trolley, which rides on an emergency access carriage attachment rail.

24. The device of claim 23 wherein the attachment trolley is attached to the support rail by set of guide wheels wherein at least two wheels on either side of the attachment rail.

25. The device of claim 20 wherein the emergency access carriage is pivotally mounted on the emergency access assembly such that the floor of the emergency access carriage remains substantially level as the emergency access assembly travels.

26. The method of claim 20 wherein the ride further comprises a second emergency access carriage, the second emergency access carriage traveling upon the second section of the stationary track, the method comprising the steps of:

moving the second emergency access carriage to be adjacent to a fourth one of the multiplicity of rider carriages;

transferring a passenger from the fourth one of the multiplicity of rider carriages to the first emergency access carriage.

27. A method for use with a vertical wheel type ride, the ride comprising a first stationary track forming a closed loop, a multiplicity of rider carriages movably mounted on the stationary track such that the multiplicity of rider carriages can move along the track for one or more circuits of the track; the ride further comprising a first emergency access assembly having a first emergency access carriage, the access assembly traveling upon a second stationary track parallel to the first stationary track, the method comprising the steps of moving the first emergency access carriage to be adjacent to a first one of the multiplicity of rider carriages;

transferring a passenger from the first one of the multiplicity of rider carriages to the first emergency access carriage;

moving the first emergency access carriage to be adjacent to a second one of the multiplicity of rider carriages; and transferring a passenger from the second one of the multiplicity of rider carriages to the first emergency access carriage.

28. The method of claim 27 wherein a third one of the multiplicity of rider carriages is located between the second one of the multiplicity of rider carriages and the first one of the multiplicity of rider carriages.

29. The method of claim 28 wherein the ride further comprises a second emergency access carriage, the second emergency access carriage traveling upon the second stationary track, the method comprising the steps of:

moving the second emergency access carriage to be adjacent to a fourth one of the multiplicity of rider carriages;

transferring a passenger from the fourth one of the multiplicity of rider carriages to the first emergency access carriage.

30. A method for use with a vertical wheel type ride, the ride comprising a first section of a stationary track forming a closed loop, a multiplicity of rider carriages movably mounted on the stationary track such that the multiplicity of rider carriages can move along the track for one or more circuits of the track; the ride further comprising a first emergency access assembly having a first emergency access carriage, the access assembly traveling a second section of the stationary track, the method comprising the steps of:

moving the first emergency access carriage to be adjacent to a first one of the multiplicity of rider carriages;

transferring a passenger from the first one of the multiplicity of rider carriages to the first emergency access carriage;

moving the first emergency access carriage to be adjacent to a second one of the multiplicity of rider carriages; and transferring a passenger from the second one of the multiplicity of rider carriages to the first emergency access carriage.

31. The method of claim 30 wherein a third one of the multiplicity of rider carriages is located between the second one of the multiplicity of rider carriages and the first one of the multiplicity of rider carriages.

* * * * *